US012258645B2

(12) United States Patent
Hirashima et al.

(10) Patent No.: US 12,258,645 B2
(45) Date of Patent: Mar. 25, 2025

(54) HIGH-STRENGTH STEEL SHEET AND METHOD FOR PRODUCING THE SAME

(71) Applicant: JFE STEEL CORPORATION, Tokyo (JP)

(72) Inventors: Takuya Hirashima, Tokyo (JP); Yuma Honda, Tokyo (JP); Akinori Nakamura, Tokyo (JP); Shinjiro Kaneko, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 854 days.

(21) Appl. No.: 17/426,897

(22) PCT Filed: Dec. 19, 2019

(86) PCT No.: PCT/JP2019/049749
§ 371 (c)(1),
(2) Date: Jul. 29, 2021

(87) PCT Pub. No.: WO2020/158228
PCT Pub. Date: Aug. 6, 2020

(65) Prior Publication Data

US 2022/0098698 A1 Mar. 31, 2022

(30) Foreign Application Priority Data

Jan. 29, 2019 (JP) ..... 2019-012790

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/42*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |

(52) U.S. Cl.
CPC ..... *C21D 9/46* (2013.01); *C21D 8/0226* (2013.01); *C21D 8/0236* (2013.01); *C21D 8/0263* (2013.01); *C21D 8/0273* (2013.01); *C21D 8/0284* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01); *C23C 2/02* (2013.01); *C23C 2/022* (2022.08); *C23C 2/06* (2013.01); *C23C 2/28* (2013.01); *C23C 2/29* (2022.08); *C23C 2/40* (2013.01); *C21D 2211/005* (2013.01); *C21D 2211/008* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 2011/0036465 | A1* | 2/2011 | Kawasaki | C22C 38/002 148/333 |
| 2014/0230973 | A1 | 8/2014 | Fukumoto et al. | |
| 2017/0137906 | A1 | 5/2017 | Fan et al. | |
| 2019/0071746 | A1 | 3/2019 | Han et al. | |
| 2019/0078173 | A1 | 3/2019 | Takashima et al. | |
| 2019/0233926 | A1 | 8/2019 | Sano et al. | |

FOREIGN PATENT DOCUMENTS

| | | | |
|---|---|---|---|
| CN | 101871078 | A | 10/2010 |
| CN | 101939457 | A | 1/2011 |
| EP | 2 243 852 | A1 | 10/2010 |
| EP | 2 604 715 | A1 | 6/2013 |
| EP | 2 762 596 | A1 | 8/2014 |
| EP | 2 937 433 | A1 | 10/2015 |
| EP | 257 959 | A1 | 12/2017 |
| EP | 3 428 302 | A1 | 1/2019 |

(Continued)

OTHER PUBLICATIONS

Mar. 31, 2020 International Search Report issued in International Application No. PCT/JP2019/049749.

(Continued)

*Primary Examiner* — Jophy S. Koshy
(74) *Attorney, Agent, or Firm* — Oliff PLC

(57) ABSTRACT

A high-strength steel sheet having a low yield ratio and a method for producing the same. The high-strength steel sheet has a specified chemical composition and a microstructure in which ferrite is present as a major phase, and martensite is present in an area fraction of 10% or greater and less than 50% relative to an entire area of the microstructure. The martensite has an average grain diameter of 3.0 μm or less, in an entirety of the martensite, a proportion of martensite having an aspect ratio of 3 or less is 60% or greater, and the martensite having an aspect ratio of 3 or less has a carbon concentration of 0.30% or greater and 0.90% or less in mass %.

24 Claims, No Drawings

(56) References Cited

FOREIGN PATENT DOCUMENTS

| | | | | |
|---|---|---|---|---|
| EP | 3 476 963 | A1 | 5/2019 | |
| JP | H0499227 | A | 3/1992 | |
| JP | 2001-192767 | A | 7/2001 | |
| JP | 2006-219738 | A | 8/2006 | |
| JP | 2011-111671 | A | 6/2011 | |
| JP | 2011-144409 | A | 7/2011 | |
| JP | 2011-153361 | A | 8/2011 | |
| JP | 2012-177175 | A | 9/2012 | |
| JP | 2013-241636 | A | 12/2013 | |
| JP | 2014-19928 | A | 2/2014 | |
| JP | 2017-520681 | A | 7/2017 | |
| KR | 2015-0082612 | A | 7/2015 | |
| KR | 10-1767818 | B1 | 8/2017 | |
| KR | 2017-0120171 | A | 10/2017 | |
| KR | 2017-0137899 | A | 12/2017 | |
| WO | WO-2009099251 | A1 * | 8/2009 | ..... C21D 8/0205 |
| WO | 2013/051714 | A1 | 4/2013 | |
| WO | 2017/169940 | A1 | 10/2017 | |
| WO | 2018/026015 | A1 | 2/2018 | |
| WO | 2018/043456 | A1 | 3/2018 | |

OTHER PUBLICATIONS

Oct. 21, 2021 Extended Search Report issued in European Patent Application No. 19912317.5.

Dec. 14, 2022 Written Decision on Registration issued in Korean Patent Application No. 10-2021-7023532.

Oct. 10, 2022 Office Action issued in Korean Patent Application No. 2021-7023532.

Jul. 5, 2022 Office Action issued in Chinese Patent Application No. 201980090854.4.

Feb. 27, 2023 Office Action issued in Chinese Patent Application No. 201980090854.4.

* cited by examiner

HIGH-STRENGTH STEEL SHEET AND METHOD FOR PRODUCING THE SAME

TECHNICAL FIELD

This application relates to a high-strength steel sheet and a method for producing the same, the high-strength steel sheet being suitable for use in automotive structural parts and the like. More specifically, the application relates to a high-strength steel sheet having a low yield ratio and an excellent surface property and to a method for producing the same.

BACKGROUND

In recent years, from the standpoint of global environmental protection, attempts have been made to reduce exhaust gases, such as $CO_2$. The automotive industry has been developing an approach of reducing the weight of vehicle bodies to improve fuel efficiency, thereby reducing the amount of exhaust gases. One technique for reducing the weight of vehicle bodies is to increase a strength of a steel sheet that is used in motor vehicles, thereby reducing a sheet thickness thereof. Furthermore, it is known that as a strength of a steel sheet increases, ductility decreases, and, therefore, there is a need for a steel sheet that has a high strength and ductility in combination. In addition, among automotive parts, floor parts, for example, need to have an excellent surface property. Furthermore, in many cases, floor parts are formed to have a complex shape, and, therefore, there is a need for a steel sheet having a low yield ratio that does not exhibit cracking during forming and does not easily lose its shape.

In response to the need, Patent Literature 1, for example, discloses a high-strength galvanized steel sheet having a low yield ratio, which has a composition containing, in mass %, C: 0.05 to 0.20%, Si: 0.3 to 1.8%, and Mn: 1.0 to 3.0% and has a microstructure in which ferrite is present in a volume fraction of 60% or greater, martensite is present in a volume fraction of 5% or greater, retained austenite is present in a volume fraction of 2% or greater, and the ferrite has an average grain diameter of 5 μm or greater, the high-strength galvanized steel sheet, hence, having a tensile strength of 590 MPa or greater, a strength-elongation balance of 21000 MPa·% or greater, and a yield ratio of 65% or less.

Furthermore, Patent Literature 2 discloses a high-strength steel sheet, which has a chemical composition containing, in mass %, C: 0.07 to 0.2%, Si: 0.005 to 1.5%, Mn: 1.0 to 3.1%, P: 0.001 to 0.06%, S: 0.001 to 0.01%, Al: 0.005 to 1.2%, and N: 0.0005 to 0.01% and has a metallurgical structure formed of ferrite and martensite, the high-strength steel sheet, hence, having a tensile strength of 590 MPa or greater and having improved workability.

Furthermore, Patent Literature 3 discloses a high-strength steel sheet, which has a chemical composition containing, in mass %, C: 0.05 to 0.13%, Si: 0.6 to 1.2%, Mn: 1.6 to 2.4%, P: 0.1% or less, S: 0.005% or less, Al: 0.01 to 0.1%, and N: less than 0.005% and has a microstructure in which 80% or greater ferrite is present, 3 to 15% martensite is present, and 0.5 to 10% pearlite is present, each in a volume fraction, the high-strength steel sheet, hence, having a tensile strength of 590 MPa or greater and a yield ratio of 70% or less.

Furthermore, Patent Literature 4 discloses a high-strength steel sheet, which has a chemical composition containing, in mass %, C: 0.06 to 0.12%, Si: 0.4 to 0.8%, Mn: 1.6 to 2.0%, Cr: 0.01 to 1.0%, V: 0.001 to 0.1%, P: 0.05% or less, S: 0.01% or less, Sol. Al: 0.01 to 0.5%, and N: 0.005% or less and has a metallurgical structure in which equiaxed ferrite is present in a volume fraction of 50% or greater, martensite is present in a volume fraction of 5 to 15%, a retained austenite phase is present in a volume fraction of 1 to 5%, the retained austenite phase has an average grain diameter of 10 μm or less, and the retained austenite phase has an aspect ratio of 5 or less, the high-strength steel sheet, hence, having a tensile strength of 590 MPa or greater, a total elongation of 30% or greater, and a hole expansion ratio of 60% or greater.

CITATION LIST

Patent Literature

PTL 1: Japanese Unexamined Patent Application Publication No. 2001-192767

PTL 2: Japanese Unexamined Patent Application Publication No. 2011-144409

PTL 3: Japanese Unexamined Patent Application Publication No. 2012-177175

PTL 4: Japanese Unexamined Patent Application Publication No. 2014-19928

SUMMARY

Technical Problem

In the technology disclosed in Patent Literature 1, listed above, a ferrite-martensite structure is used, the grain diameter of the ferrite is limited, and as a result, a low yield ratio is achieved, and ductility is improved; however, annealing steps are carried out twice to obtain a coated steel sheet. Unfortunately, as a result of carrying out annealing steps twice, a surface of the steel sheet is susceptible to the formation of an oxide, and, therefore, excellent surface properties are not achieved.

Furthermore, in the technology disclosed in Patent Literature 2, listed above, ferrite is used as a major phase, and, consequently, workability is improved; however, since there is no disclosure of a grain diameter of the martensite, it can be presumed that a grain diameter of the martensite is uncontrolled, and, as a result, a low yield ratio is not achieved.

Furthermore, in the technology disclosed in Patent Literature 3, listed above, a ferrite-martensite structure is used, and, consequently, a low yield ratio is achieved, according to the disclosure; however, the yield ratio disclosed in Patent Literature 3 is greater than the limitation of the disclosed embodiments, which is 63% or less. Presumably, a reason for this is a failure to control a grain diameter of the martensite. The annealing temperature and the cooling stop temperature for controlling the grain diameter of the martensite disclosed in Patent Literature 3 are different from the limitations of the disclosed embodiments. Furthermore, the steel sheets having a yield ratio of 63% or less disclosed in Patent Literature 3 have Si and Mn contents higher than those of the disclosed embodiments, and, therefore, it can be assumed that the steel sheets do not have excellent surface properties.

Furthermore, in the technology disclosed in Patent Literature 4, listed above, a ferrite-martensite structure is used, a volume fraction and an average grain diameter of retained austenite are limited, and, consequently, a low yield ratio is achieved, and workability is improved; however, Cr and V are added to ensure hardenability. Unfortunately, it is known that Cr and V are elements that degrade a surface property. Achieving an excellent surface property sought by the disclosed embodiments requires a chemical composition in which contents of these elements are reduced.

The disclosed embodiments have been made in view of the problems described above, and objects of the disclosed embodiments are to provide a high-strength steel sheet having a low yield ratio and an excellent surface property and to provide a method for producing the same.

Solution to Problem

The inventors diligently performed studies to solve the problems described above. As a result, it was discovered that a high-strength steel sheet having a low yield ratio can be obtained in an instance in which an adjustment is made to achieve a specific chemical composition, a microstructure formed of ferrite and martensite constituents is used, and a grain diameter of martensite, an aspect ratio of the martensite, and a carbon concentration of the martensite are controlled. Accordingly, the disclosed embodiments were completed.

That is, the inventors discovered that achieving a strength sought by the disclosed embodiments requires that martensite be present in an area fraction of 10% or greater, and achieving a low yield ratio sought by the disclosed embodiments requires that the martensite be present in an area fraction of less than 50%, martensite having an aspect ratio of 3 or less be present in an amount of 60% or greater in the entire martensite, the martensite having an aspect ratio of 3 or less have a carbon concentration of 0.3% or greater and 0.9% or less in mass %, and the martensite have an average grain diameter of 3.0 μm or less. Note that the aspect ratio is a value calculated by dividing a major dimension by a minor dimension.

The disclosed embodiments were made based on the discoveries described above, and a summary of the disclosed embodiments is as follows.

[1] A high-strength steel sheet, the high-strength steel sheet having a chemical composition containing, in mass %, C: 0.06% or greater and 0.120% or less, Si: 0.3% or greater and 0.7% or less, Mn: 1.6% or greater and 2.2% or less, P: 0.05% or less, S: 0.0050% or less, Al: 0.01% or greater and 0.20% or less, and N: 0.010% or less, with the balance being Fe and incidental impurities, the high-strength steel sheet having a microstructure in which ferrite is present as a major phase, and martensite is present in an area fraction of 10% or greater and less than 50% relative to an area of an entirety of the microstructure, wherein the martensite has an average grain diameter of 3.0 μm or less; in an entirety of the martensite, a proportion of martensite having an aspect ratio of 3 or less is 60% or greater; and the martensite having an aspect ratio of 3 or less has a carbon concentration of 0.30% or greater and 0.90% or less in mass %.

[2] The high-strength steel sheet according to [1], wherein the chemical composition further contains, in mass %, one or more selected from Cr: 0.01% or greater and 0.20% or less, Mo: 0.01% or greater and less than 0.15%, and V: 0.001% or greater and 0.05% or less.

[3] The high-strength steel sheet according to [1] or [2], wherein the chemical composition further contains, in mass %, one or more selected from Groups A to C described below:

Group A: one or two selected from Nb: 0.001% or greater and 0.02% or less and Ti: 0.001% or greater and 0.02% or less, Group B: one or two selected from Cu: 0.001% or greater and 0.20% or less and Ni: 0.001% or greater and 0.10% or less, and Group C: B: 0.0001% or greater and 0.002% or less.

[4] The high-strength steel sheet according to any one of [1] to [3], wherein a surface of the steel sheet has a coating layer.

[5] A method for producing a high-strength steel sheet, the method including heating a steel slab having the chemical composition according to any one of [1] to [3] and subsequently subjecting the steel slab to a hot rolling step; and subjecting a hot-rolled steel sheet obtained in the hot rolling step to an annealing step in which the hot-rolled steel sheet is held at an annealing temperature of an $A_{C1}$ temperature or greater and an $A_{C3}$ temperature or less for 30 seconds or more, a resulting steel sheet is cooled under conditions in which an average cooling rate over a range from the annealing temperature to 350° C. is 5° C./second or greater, and a cooling stop temperature is 350° C. or less, and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200 to 250° C.

[6] A method for producing a high-strength steel sheet, the method including heating a steel slab having the chemical composition according to any one of [1] to [3] and subsequently subjecting the steel slab to a hot rolling step; thereafter subjecting a hot-rolled steel sheet obtained in the hot rolling step to a cold rolling step; and subjecting a cold-rolled steel sheet obtained in the cold rolling step to an annealing step in which the cold-rolled steel sheet is held at an annealing temperature of an $A_{C1}$ temperature or greater and an $A_{C3}$ temperature or less for 30 seconds or more, a resulting steel sheet is cooled under conditions in which an average cooling rate over a range from the annealing temperature to 350° C. is 5° C./second or greater, and a cooling stop temperature is 350° C. or less, and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200 to 250° C.

[7] The method for producing a high-strength steel sheet according to [5] or [6], the method further including performing a coating process after the annealing step.

Advantageous Effects

In the disclosed embodiments, by adjusting a chemical composition and a production method, a microstructure is controlled, and in addition, a grain diameter of martensite, an aspect ratio of the martensite, and a carbon concentration of the martensite are controlled. As a result, high-strength steel sheets of the disclosed embodiments have an excellent surface property and a low yield ratio.

In addition, in cases where a high-strength steel sheet of the disclosed embodiments is used in an automotive structural member, a high strength and a low yield ratio of an automotive steel sheet can be achieved in combination. That is, with the disclosed embodiments, the performance of motor vehicle bodies can be enhanced.

DETAILED DESCRIPTION

Disclosed embodiments will be described below. It will be understood that the disclosure is not intended to be limited to these embodiments.

First, a chemical composition of a high-strength steel sheet of the disclosed embodiments (hereinafter sometimes referred to as a "steel sheet of the disclosed embodiments") will be described. In the following description of the chemical composition, the "%" unit used to indicate a content of a component means "mass %".

C: 0.06% or Greater and 0.120% or Less

C is an element that improves hardenability and is necessary for ensuring a predetermined area fraction of martensite. Furthermore, C is an element that increases the strength of martensite and is, therefore, necessary from the standpoint of ensuring a strength (TS) of 590 MPa or greater, which is sought by the disclosed embodiments. If a C content is less than 0.06%, the mentioned predetermined strength cannot be achieved. Accordingly, the C content is specified to be greater than or equal to 0.06%. The C content is preferably greater than or equal to 0.065% and more preferably greater than or equal to 0.070%. On the other hand, if the C content is greater than 0.120%, the area fraction of martensite is increased, and, therefore, a yield ratio is increased. Accordingly, the C content is specified to be less than or equal to 0.120%. The C content is preferably less than or equal to 0.115% and more preferably less than or equal to 0.11%.

Si: 0.3% or Greater and 0.7% or Less

Si is an element that enables strengthening through solid-solution strengthening. To produce the above-described effects of the disclosed embodiments, a Si content is specified to be greater than or equal to 0.3%. The Si content is preferably greater than or equal to 0.35% and more preferably greater than or equal to 0.40%. On the other hand, if the Si content is too high, the strength of ferrite is increased, and, therefore, the yield ratio is increased. Furthermore, if an excessive amount of Si is present, an oxide forms on a surface of the steel sheet, and, consequently, a surface property is significantly degraded. Accordingly, the Si content is specified to be less than or equal to 0.7%. The Si content is preferably less than or equal to 0.64% and more preferably less than or equal to 0.60%.

Mn: 1.6% or Greater and 2.2% or Less

Mn is to be present so as to improve the hardenability of the steel and ensure the predetermined area fraction of martensite. If a Mn content is less than 1.6%, ferrite forms in a surface layer portion of the steel sheet, and, consequently, the strength is degraded. Furthermore, pearlite or bainite forms during cooling, and, consequently, the yield ratio is increased. Accordingly, the Mn content is specified to be greater than or equal to 1.6%. The Mn content is preferably greater than or equal to 1.65% and more preferably greater than or equal to 1.70%. On the other hand, if an excessive amount of Mn is present, an oxide forms on a surface of the steel sheet, and, consequently, a surface property is significantly degraded. Accordingly, the Mn content is specified to be less than or equal to 2.2%. The Mn content is preferably less than or equal to 2.14% and more preferably less than or equal to 2.10%.

P: 0.05% or Less

P is an element that strengthens steel. However, if a content of P is high, P segregates at grain boundaries and, therefore, degrades workability. Accordingly, a P content is specified to be less than or equal to 0.05% to achieve at least a minimum workability necessary for using the steel sheet of the disclosed embodiments as a steel sheet for automotive use. The P content is preferably less than or equal to 0.03% and more preferably less than or equal to 0.01%. Note that the lower limit of the P content is not particularly limited; currently, an industrially feasible lower limit is approximately 0.003%. Accordingly, preferably, the P content is specified to be greater than or equal to 0.003%. More preferably, the P content is greater than or equal to 0.005%.

S: 0.0050% or Less

S degrades workability by forming MnS and/or the like. Furthermore, in instances where Ti is present with S, S may degrade workability by forming TiS, Ti(C, S), and/or the like. Accordingly, a S content is specified to be less than or equal to 0.0050% to achieve at least a minimum workability necessary for using the steel sheet of the disclosed embodiments as a steel sheet for automotive use. The S content is preferably less than or equal to 0.0020%, more preferably less than or equal to 0.0010%, and even more preferably less than or equal to 0.0005%. Note that the lower limit of the S content is not particularly limited; currently, an industrially feasible lower limit is approximately 0.0002%. Accordingly, preferably, the S content is specified to be greater than or equal to 0.0002%. More preferably, the S content is greater than or equal to 0.0005%.

Al: 0.01% or Greater and 0.20% or Less

Al is added to accomplish sufficient deoxidation and reduce coarse inclusions present in the steel. This effect is exhibited when an Al content is greater than or equal to 0.01%. Preferably, the Al content is greater than or equal to 0.02%. More preferably, the Al content is greater than or equal to 0.03%. On the other hand, if the Al content is greater than 0.20%, Fe-based carbides, such as cementite, that form during coiling after hot rolling are not easily dissolved in an annealing step, and, therefore, coarse inclusions and carbides form; as a result, workability is degraded. Accordingly, the Al content is specified to be less than or equal to 0.20% to achieve at least a minimum workability necessary for using the steel sheet of the disclosed embodiments as a steel sheet for automotive use. The Al content is preferably less than or equal to 0.17% and more preferably less than or equal to 0.15%.

N: 0.010% or Less

N is an element that forms coarse nitride inclusions, such as AlN, in steel and degrades workability by forming such inclusions. Furthermore, in instances where Ti is present with N, N is an element that forms coarse inclusions, examples of the inclusions including nitride inclusions and carbonitride inclusions, such as TiN and (Nb, Ti)(C, N); consequently, N may degrade workability by forming such inclusions. Accordingly, a N content is specified to be less than or equal to 0.010% to achieve at least a minimum workability necessary for using the steel sheet of the disclosed embodiments as a steel sheet for automotive use. The N content is preferably less than or equal to 0.007% and more preferably less than or equal to 0.005%. Note that the lower limit of the N content is not particularly limited; currently, an industrially feasible lower limit is approximately 0.0006%. Accordingly, preferably, the N content is specified to be greater than or equal to 0.0006%. More preferably, the N content is greater than or equal to 0.0010%.

The components described above are the basic components of the steel sheet used in the disclosed embodiments. The steel sheet used in the disclosed embodiments has a chemical composition that contains the above-described basic components, with the balance, other than the components described above, including Fe (iron) and incidental impurities. It is preferable that the steel sheet of the disclosed embodiments has a chemical composition that contains the above-described components, with the balance consisting of Fe and incidental impurities.

The steel sheet of the disclosed embodiments may contain the following components as optional components, in addition to the components described above. Note that in the disclosed embodiments, in instances where any of the following optional components is present in an amount less than the lower limit thereof, it is to be assumed that the component is present as an incidental impurity, which will be described later.

One or More Selected from Cr: 0.01% or Greater and 0.20% or Less, Mo: 0.01% or Greater and Less than 0.15%, and V: 0.001% or Greater and 0.05% or Less Cr, Mo, and/or V may be included to produce an effect of improving the hardenability of the steel. In instances where Cr and/or Mo are to be included, it is preferable that a Cr content be greater than or equal to 0.01%, and/or a Mo content be greater than or equal to 0.01%, so as to produce the effect. More preferably, the contents are greater than or equal to 0.02%, separately, and even more preferably, greater than or equal to 0.03%, separately. In instances where V is to be included, it is preferable that a V content be greater than or equal to 0.001%, so as to produce the above-described effect. More preferably, the content is greater than or equal to 0.002%, and even more preferably, greater than or equal to 0.003%.

However, if the content of any of these elements is excessive, an oxide-forming reaction that involves generation of hydrogen ions may be induced. As a result, an increase in the pH of a surface of the base metal is hindered, which in turn hinders the precipitation of a zinc phosphate crystal, and, consequently, conversion coating failure may be caused. Accordingly, in instances where Cr is to be included, it is preferable that the Cr content be less than or equal to 0.20%. More preferably, the Cr content is less than or equal to 0.15%, and even more preferably, less than or equal to 0.10%. In instances where Mo is to be included, it is preferable that the Mo content be less than 0.15%. More preferably, the Mo content is less than or equal to 0.1%, and even more preferably, less than or equal to 0.05%. In instances where V is to be included, it is preferable that the V content be less than or equal to 0.05%. More preferably, the V content is less than or equal to 0.03%, and even more preferably, less than or equal to 0.01%.

One or Two Selected from Nb: 0.001% or Greater and 0.02% or Less and Ti: 0.001% or Greater and 0.02% or Less Nb and Ti contribute to increasing strength by refining prior γ grains and forming fine precipitates. In instances where one or two selected from Nb and Ti are to be included, it is preferable that a Nb content be greater than or equal to 0.001%, and/or a Ti content be greater than or equal to 0.001%, so as to produce the effect. More preferably, the contents are greater than or equal to 0.0015%, separately, and even more preferably, greater than or equal to 0.0020%, separately. On the other hand, if Nb and/or Ti are included in a large amount, a surface property may be degraded. Accordingly, in instances where one or two selected from Nb and Ti are to be included, it is preferable that the Nb content be less than or equal to 0.02%, and/or the Ti content be less than or equal to 0.02%. More preferably, the contents are less than or equal to 0.017%, separately, and even more preferably, less than or equal to 0.015%, separately.

One or Two Selected from Cu: 0.001% or Greater and 0.20% or Less and Ni: 0.001% or Greater and 0.10% or Less Cu and Ni have an effect of improving corrosion resistance exhibited in a motor vehicle usage environment and an effect of forming a corrosion product that coats a surface of a steel sheet, thereby inhibiting hydrogen from being penetrated into the steel sheet. In instances where one or two selected from Cu and Ni are to be included, it is preferable that a Cu content be greater than or equal to 0.001%, and/or a Ni content be greater than or equal to 0.001%, so as to produce these effects. More preferably, the contents are greater than or equal to 0.002%, separately, and even more preferably, greater than or equal to 0.003%, separately. However, if the Cu content and/or the Ni content are too high, a surface defect may occur, and, consequently, a surface property may be degraded. Accordingly, in instances where Cu is to be included, it is preferable that the Cu content be less than or equal to 0.20%. More preferably, the Cu content is less than or equal to 0.15%, and even more preferably, less than or equal to 0.1%. In instances where Ni is to be included, it is preferable that the Ni content be less than or equal to 0.10%. More preferably, the Ni content is less than or equal to 0.07%, and even more preferably, less than or equal to 0.05%.

B: 0.0001% or Greater and 0.002% or Less

B is an element that improves the hardenability of steel. When B is present, the effect of forming a predetermined area fraction of martensite is produced even when the Mn content is low. In instances where B is to be included, it is preferable that a B content be greater than or equal to 0.0001% so as to produce the effect. More preferably, the B content is greater than or equal to 0.0003%, and even more preferably, greater than or equal to 0.0005%. On the other hand, if the B content is greater than 0.002%, coarsening of Mn oxides is promoted, and, consequently, a surface property may be degraded. Accordingly, in instances where B is to be included, it is preferable that the B content be less than or equal to 0.002%. More preferably, the B content is less than or equal to 0.0015%, and even more preferably, less than or equal to 0.0010%.

Now, a microstructure of the high-strength steel sheet of the disclosed embodiments will be described.

The steel sheet of the disclosed embodiments has a microstructure in which ferrite is present as a major phase, and martensite is present in an area fraction of 10% or greater and less than 50% relative to an area of the entirety of the microstructure. The martensite has an average grain diameter of 3.0 μm or less. In the entirety of the martensite, a proportion of martensite having an aspect ratio of 3 or less is 60% or greater. The martensite having an aspect ratio of 3 or less has a carbon concentration of 0.30% or greater and 0.90% or less in mass %. Note that in the descriptions below, the "area fraction" refers to an area fraction relative to the area of the entirety of the microstructure.

In the disclosed embodiments, ferrite is present as a major phase. In the disclosed embodiments, the "major phase" refers to a constituent that is present in an area fraction ranging from 50 to 100% relative to the area of the entirety of the microstructure. Accordingly, "ferrite is present as a major phase" means that ferrite is present in an area fraction of 50 to 90% relative to the area of the entirety of the microstructure. In the disclosed embodiments, it is necessary that ferrite be present as a major phase, from the standpoint of reducing a yield strength to achieve a good yield ratio. The lower limit of the area fraction of the ferrite is preferably 55% or greater and more preferably 60% or greater. The upper limit is preferably 85% or less and more preferably 80% or less. The "ferrite", as referred to herein, is recrystallized ferrite and does not include unrecrystallized ferrite, which is not recrystallized.

Area Fraction of Martensite: 10% or Greater and Less than 50%

To achieve a high strength of 590 MPa or greater in terms of TS in the steel sheet of the disclosed embodiments as described above, an area fraction of the martensite relative to the area of the entirety of the microstructure is specified to be greater than or equal to 10%. The area fraction is preferably greater than or equal to 15% and more preferably greater than or equal to 20%. On the other hand, if the area fraction of the martensite relative to the area of the entirety of the microstructure is greater than or equal to 50%, the martensite is present as a major phase; hence, a C content of the martensite is reduced, and as a result, the yield ratio is increased. Accordingly, the area fraction of the martensite is specified to be less than 50%. The area fraction is preferably less than or equal to 45% and more preferably less than or equal to 40%.

Note that in the disclosed embodiments, the remaining constituents, other than the ferrite and the martensite, are one or more selected from retained austenite, bainite, unrecrystallized ferrite, and pearlite, and a permissible total amount thereof is less than or equal to 10.0% in terms of an area fraction. Regarding the remaining constituents other than the ferrite and the martensite, the total amount of the one or more selected from retained austenite, bainite, unrecrystallized ferrite, and pearlite is preferably less than or equal to 7.0% and more preferably less than or equal to 5.0% in terms of the area fraction. Note that the area fraction of the remaining constituents may be 0%.

In the disclosed embodiments, the ferrite is a constituent that is formed at a relatively high temperature as a result of transformation from austenite and is formed of BCC lattice grains. The unrecrystallized ferrite is a constituent containing white elongated strains remaining in the ferrite grains. The martensite is a hard constituent that is formed from austenite at a low temperature (a temperature less than or equal to the martensitic transformation temperature). The bainite is a hard constituent that is formed from austenite at a relatively low temperature (a temperature greater than or equal to the martensitic transformation temperature) and includes acicular or plate-shaped ferrite and fine carbides dispersed therein. The pearlite is a constituent that is formed from austenite at a relatively high temperature and is formed of lamellar ferrite and cementite. The retained austenite is a constituent that is formed when enrichment of an element such as C in austenite causes the martensitic transformation temperature to be shifted to a temperature less than or equal to room temperature.

Note that in the disclosed embodiments, the value of the area fraction of each of the constituents in the microstructure is a value obtained by performing a measurement in accordance with a method to be described in the Examples section below.

Average Grain Diameter of Martensite: 3.0 μm or Less

Achieving a low yield ratio sought by the disclosed embodiments requires that a strength of the ferrite be reduced, and a strength of the martensite be increased. An effective way to achieve this is to reduce an average grain diameter of the martensite. Producing the effects described above requires that the average grain diameter of the martensite be less than or equal to 3.0 μm. The average grain diameter is preferably less than 3.0 μm, more preferably less than or equal to 2.7 μm, and even more preferably less than or equal to 2.0 μm. The lower limit of the average grain diameter of the martensite is not particularly limited and is preferably 0.5 μm or greater and more preferably 0.8 μm or greater.

Note that in the disclosed embodiments, the average grain diameter of the martensite in the microstructure is a value obtained by performing a measurement in accordance with a method to be described in the Examples section below.

Proportion of Martensite Having Aspect Ratio of 3 or Less in Entirety of Martensite: 60% or Greater Unlike acicular martensite, martensite having an aspect ratio of 3 or less has high strength. Accordingly, martensite having an aspect ratio of 3 or less is an important constituent in terms of achieving a low yield ratio sought by the disclosed embodiments. In cases where the area fraction of the martensite having an aspect ratio of 3 or less is less than 60% relative to the area fraction of the entire martensite, the area fraction of less than 60% is insufficient for achieving a low yield ratio sought by the disclosed embodiments. Accordingly, a proportion of the martensite having an aspect ratio of 3 or less in the entirety of the martensite is specified to be 60% or greater in terms of an area fraction. The proportion is preferably greater than or equal to 65% and more preferably greater than or equal to 70%. The upper limit of the proportion of the martensite having an aspect ratio of 3 or less in the entirety of the martensite is not particularly limited and may be 100%. More preferably, the upper limit is 90% or less.

Note that in the disclosed embodiments, the aspect ratio of the martensite in the microstructure is a value obtained by performing a measurement in accordance with a method to be described in the Examples section below.

Carbon Concentration of Martensite Having Aspect Ratio of 3 or Less: 0.30% or Greater and 0.90% or Less in Mass %

Increasing the strength of the martensite and achieving a low yield ratio sought by the disclosed embodiments requires that a carbon concentration of the martensite having an aspect ratio of 3 or less be increased. Producing the effects described above requires that the carbon concentration of the martensite having an aspect ratio of 3 or less be greater than or equal to 0.30% in mass %. The carbon concentration is preferably greater than or equal to 0.35% and more preferably greater than or equal to 0.40%. On the other hand, if the carbon concentration of the martensite having an aspect ratio of 3 or less is greater than 0.90% in mass %, austenite remains, without undergoing a martensitic transformation; as a result, the area fraction of the martensite is less than 10%, and, therefore, the strength is decreased. Accordingly, the carbon concentration of the martensite having an aspect ratio of 3 or less needs to be specified to be less than or equal to 0.90% in mass %. The carbon concentration is preferably less than or equal to 0.85% and more preferably less than or equal to 0.8%.

Note that in the disclosed embodiments, the carbon concentration of the martensite having an aspect ratio of 3 or less in the microstructure is a value obtained by performing a measurement in accordance with a method to be described in the Examples section below.

Regarding measurement positions, in the disclosed embodiments, the microstructure described above is uniform across a sheet thickness region, excluding a region of an outermost layer measuring 10 μm in the sheet thickness direction. Accordingly, regarding the sheet thickness measurement positions, measurements may be performed at any position within the region in which the microstructure is uniform.

In the steel sheet of the disclosed embodiments, a surface of the steel sheet may have a coating layer. Preferably, the coating layer may be a galvanized layer (hereinafter sometimes referred to as "GI"), a galvannealed layer (hereinafter sometimes referred to as "GA"), or an electrogalvanized layer (hereinafter sometimes referred to as "EG").

Note that the metal of the coating may be a metal other than zinc. For example, an Al coating or the like may be used.

It is preferable that an Fe content of the coating layer be within a range of 7 to 16 mass %. If the Fe content is less than 7 mass %, uneven alloying may occur, and/or a flaking property may be degraded. On the other hand, if the Fe content is greater than 16 mass %, peel resistance may be degraded.

Now, properties (mechanical properties) of the high-strength steel sheet of the disclosed embodiments will be described.

As described above, the steel sheet of the disclosed embodiments has high strength. Specifically, the steel sheet has a tensile strength (TS) of 590 MPa or greater as measured in accordance with a method to be described in the Examples section below. Note that the upper limit of the tensile strength is not particularly limited; preferably, the tensile strength is less than or equal to 780 MPa because in such a case, a balance with other properties is easily achieved.

Furthermore, the steel sheet of the disclosed embodiments has a low yield ratio (YR). Specifically, the steel sheet has a yield ratio (YR=YS/TS) of 0.63 or less, the yield ratio being a ratio calculated from the values of the tensile strength (TS) and the yield strength (YS), which are measured in accordance with a method to be described in the Examples section below. The yield ratio is preferably less than or equal to 0.61 and more preferably less than or equal to 0.59. Note that the lower limit of the yield ratio is not particularly limited; preferably, the yield ratio is greater than or equal to 0.4 because in such a case, a balance with other properties is easily achieved. More preferably, the yield ratio is greater than or equal to 0.45.

Note that in the steel sheet of the disclosed embodiments, the properties of a yield ratio of 0.63 or less and a tensile strength of 590 MPa or greater can be achieved in cases in which an annealing temperature of an $A_{C1}$ temperature or greater and an $A_{C3}$ temperature or less and a cooling stop temperature of 350° C. or less are employed.

In addition, the steel sheet of the disclosed embodiments has an excellent surface property. As referred to herein, the "surface property" is chemical convertibility in instances in which the steel sheet is a hot-rolled steel sheet or a cold-rolled steel sheet, and the "surface property" is coating adhesion in instances in which the steel sheet is a coated steel sheet.

Specifically, when the steel sheet was a hot-rolled steel sheet or a cold-rolled steel sheet, an evaluation was made of whether or not excellent chemical convertibility was achieved; the evaluation was made by calculating a coverage ratio of conversion crystals that have been measured, by using a method for evaluation of chemical convertibility, which was carried out in accordance with a method to be described in the Examples section below. In the disclosed embodiments, in instances in which the coverage ratio, which is a ratio in terms of an area fraction, was 95% or greater, a symbol "○" was assigned, in instances in which the coverage ratio was 90% or greater and less than 95%, a symbol "Δ" was assigned, and in instances in which the coverage ratio was less than 90%, a symbol "×" was assigned. It was determined that the symbols "○" and "Δ" represented instances in which good chemical convertibility was exhibited (i.e., excellent chemical convertibility was exhibited).

When the steel sheet was a coated steel sheet, an evaluation was made of whether or not excellent coating adhesion was achieved, by visually examining the appearance. In the disclosed embodiments, steel sheets free of bare spot defects were assigned a symbol "○", steel sheets that exhibited a bare spot defect were assigned a symbol "×", and steel sheets that were free of bare spot defects but had a non-uniform coating appearance or the like were assigned a symbol "Δ". Note that the "bare spot defect" refers to an uncoated, exposed region of a steel sheet on the order of approximately several micrometers to several millimeters. It was determined that the symbols "○" and "Δ" represented instances in which the coating was sufficiently adhered, and, therefore, good coating adhesion was achieved (i.e., excellent coating adhesion was achieved).

Now, methods of the disclosed embodiments for producing a high-strength steel sheet will be described.

The methods of the disclosed embodiments for producing a high-strength steel sheet include a hot rolling step, which is described below, a cold rolling step, which is optional, and an annealing step. Note that in the description below, the temperature is a temperature of a surface of the steel sheet unless otherwise specified. The temperature of the surface of the steel sheet may be measured by using a radiation pyrometer or the like.

Hot Rolling Step

A steel starting material (steel slab) having the chemical composition described above is subjected to a hot rolling step. Note that it is preferable that the steel slab to be used be produced by a continuous casting method so that macro segregation of a component can be prevented. Alternatively, the steel slab may be produced by an ingot casting method or a thin slab casting method.

Preferred conditions for the hot rolling step of the disclosed embodiments are as follows, for example. First, a steel slab having the chemical composition described above is heated. If the heating temperature for the steel slab is less than 1200° C., a sulfide may be precipitated, which may degrade workability. Accordingly, in terms of achieving at least a minimum workability necessary for using a high-strength steel sheet produced in the disclosed embodiments as a steel sheet for automotive use, it is preferable that the heating temperature for the steel slab be greater than or equal to 1200° C. More preferably, the heating temperature is greater than or equal to 1230° C., and even more preferably, greater than or equal to 1250° C. Note that the upper limit of the heating temperature for the steel slab is not particularly limited and is preferably 1400° C. or less. More preferably, the upper limit is 1350° C. or less.

Furthermore, it is preferable that an average heating rate for the heating of the steel slab be 5 to 15° C./minute, and a soaking time for the steel slab be 30 to 100 minutes. As referred to herein, the "average heating rate for the heating of the steel slab" is an average of the heating rates over a period starting from the time at which the heating is started to the time at which the surface temperature of the steel slab reaches the heating temperature mentioned above. The "soaking time for the steel slab" is a time period from the time at which the heating temperature mentioned above is reached to the time at which the hot rolling is started.

It is preferable that, after the steel slab is heated, the hot rolling be performed under the conditions described below.

It is preferable that a finishing delivery temperature be greater than or equal to 840° C. If the finishing delivery temperature is less than 840° C., it takes a long time to reduce the temperature to a coiling temperature, which may cause oxidation of a surface of the base metal, and, consequently, the surface property may be degraded. Accordingly, it is preferable that the finishing delivery temperature be greater than or equal to 840° C. More preferably, the finishing delivery temperature is greater than or equal to 860° C. On the other hand, the upper limit of the finishing delivery temperature is not particularly limited. It is preferable that the finishing delivery temperature be less than or equal to 950° C. because, otherwise, cooling the steel sheet to a coiling temperature, which will be described later, is difficult. More preferably, the finishing delivery temperature is less than or equal to 920° C.

It is preferable that a reduction ratio for the finish rolling be greater than or equal to 70%, from the standpoint of achieving the aspect ratio of martensite of 3 or less. It is preferable that the reduction ratio be less than or equal to 95%, from the standpoint of ensuring the area fraction of ferrite.

If the coiling temperature is greater than 700° C., the surface of the base metal may undergo decarburization, which results in a difference in the microstructure between an inner portion of the steel sheet and the surface of the steel sheet, which can be a cause of uneven alloying concentration. Furthermore, the decarburization causes the formation of ferrite in a surface layer of the steel sheet, which reduces the tensile strength. Accordingly, it is preferable that the coiling temperature be less than or equal to 700° C. More preferably, the coiling temperature is less than or equal to 670° C. The lower limit of the coiling temperature is not particularly limited. In instances where cold rolling is performed after the hot rolling, it is preferable that the coiling temperature be greater than or equal to 550° C. so that deterioration in cold rollability can be prevented. In instances where cold rolling is not performed, it is preferable that the coiling temperature be greater than or equal to 300° C. because if the coiling temperature is less than 300° C., coiling of the hot-rolled steel sheet is difficult.

The hot-rolled steel sheet after coiling may be subjected to pickling. In this instance, conditions for the pickling are not particularly limited. Note that the pickling of the hot-rolled steel sheet after hot rolling may not be performed.

Cold Rolling Step

The cold rolling step is a step in which the hot-rolled steel sheet obtained in the hot rolling step is subjected to cold rolling as necessary. In instances where the cold rolling step is performed, it is preferable that the cold rolling be performed under the conditions described below in the disclosed embodiments.

A reduction ratio for the cold rolling is not particularly limited; however, if the reduction ratio is less than 20%, the flatness of the surface of the steel sheet is degraded, and the resulting structure may be non-uniform. Accordingly, it is preferable that the reduction ratio be greater than or equal to 20%. More preferably, the reduction ratio is greater than or equal to 30%. Even more preferably, the reduction ratio is greater than or equal to 40%. On the other hand, if the reduction ratio is greater than 90%, unrecrystallized ferrite may remain. Accordingly, it is preferable that the reduction ratio be less than or equal to 90%. More preferably, the reduction ratio is less than or equal to 80%. Even more preferably, the reduction ratio is less than or equal to 70%.

Note that in the disclosed embodiments, the cold rolling step is not an essential step; the cold rolling step may be omitted provided that the above-described microstructure and mechanical properties of the disclosed embodiments can be achieved.

Annealing Step

The annealing step is a step in which annealing is performed on the hot-rolled steel sheet obtained in the hot rolling step described above or on the cold-rolled steel sheet obtained in the cold rolling step described above. In the disclosed embodiments, the annealing step is performed under the conditions described below.

The annealing step is a step in which the obtained hot-rolled steel sheet or cold-rolled steel sheet is held at an annealing temperature of an $A_{C1}$ temperature or greater and an $A_{C3}$ temperature or less for 30 seconds or more; subsequently, the resulting steel sheet is cooled under conditions in which an average cooling rate over a range from the annealing temperature to 350° C. is 5° C./second or greater, and a cooling stop temperature is 350° C. or less; and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200 to 250° C.

The hot-rolled steel sheet or cold-rolled steel sheet is heated to an annealing temperature of an $A_{C1}$ temperature or greater and an $A_{C3}$ temperature or less and then held within the temperature range. If the annealing temperature is less than the $A_{C1}$ temperature, an excessive amount of cementite forms, and, consequently, the resulting area fraction of the martensite is less than 10%. Accordingly, the annealing temperature is specified to be greater than or equal to the $A_{C1}$ temperature. Preferably, the annealing temperature is greater than or equal to (the $A_{C1}$ temperature+10° C.). On the other hand, if the annealing temperature is greater than the $A_{C3}$ temperature, the resulting area fraction of the martensite is greater than 50%, and the resulting average grain diameter of the martensite is greater than or equal to 3.0 μm, which increase the yield ratio. Furthermore, when the area fraction of the martensite is large, the carbon concentration of the martensite having an aspect ratio of 3 or less is reduced, which reduces the strength of the martensite; as a result, the yield ratio is increased. Accordingly, the annealing temperature is specified to be less than or equal to the $A_{C3}$ temperature. Preferably, the annealing temperature is less than or equal to (the $A_{C3}$ temperature−10° C.)

Note that the $A_{C1}$ temperature and the $A_{C3}$ temperature as referred to herein are calculated by using the following equations.

$$A_{C1}\ (^\circ\text{C.}) = 723 + 22(\%\ \text{Si}) - 18(\%\ \text{Mn}) + 17(\%\ \text{Cr}) + 4.5(\%\ \text{Mo}) + 16(\%\ \text{V})$$

$$A_{C3}\ (^\circ\text{C.}) = 910 - 203(\%\ \text{C})^{1/2} + 45(\%\ \text{Si}) - 30(\%\ \text{Mn}) - 20(\%\ \text{Cu}) - 15(\%\ \text{Ni}) + 11(\%\ \text{Cr}) + 32(\%\ \text{Mo}) + 104(\%\ \text{V}) + 400(\%\ \text{Ti}) + 460(\%\ \text{Al})$$

In each of the equations, "(% chemical symbol)" represents a content (mass %) of the chemical symbol in the steel, and when it is not present, the content is 0.

A holding time associated with the annealing temperature (annealing holding time) is specified to be greater than or equal to 30 seconds. If the annealing holding time is less than 30 seconds, the recrystallization of ferrite does not sufficiently progress; consequently, the ferrite is unrecrystallized ferrite, which increases the yield ratio. Furthermore, diffusion of carbon is not promoted; consequently, the C concentration of the martensite having an aspect ratio of 3 or less is low, which increases the yield ratio. Accordingly, the annealing holding time is specified to be greater than or equal to 30 seconds. Preferably, the annealing holding time is greater than or equal to 35 seconds. More preferably, the annealing holding time is greater than or equal to 50 seconds. The upper limit of the annealing holding time is not particularly limited. From the standpoint of inhibiting the coarsening of a grain diameter of the austenite, thereby preventing an increase in the yield ratio that may be caused if the grain diameter of the martensite is coarse, it is preferable that the annealing holding time be less than or equal to 900 seconds. More preferably, the annealing holding time is less than or equal to 500 seconds, and even more preferably, less than or equal to 300 seconds.

After being held at the annealing temperature, the hot-rolled steel sheet or cold-rolled steel sheet is cooled under conditions in which an average cooling rate over a range from the annealing temperature to 350° C. is 5° C./second or greater, and a cooling stop temperature is 350° C. or less. If the cooling stop temperature is greater than 350° C., bainite and/or pearlite form in a subsequent step, which increases the yield ratio. Accordingly, the cooling stop temperature is specified to be less than or equal to 350° C. Preferably, the cooling stop temperature is less than or equal to 320° C. More preferably, the cooling stop temperature is less than or equal to 300° C.

If the average cooling rate over the range from the annealing temperature to 350° C. is less than 5° C./second, large amounts of bainite and/or pearlite form, which increases the yield ratio. Accordingly, the average cooling rate is specified to be greater than or equal to 5° C./second. Preferably, the average cooling rate is greater than or equal to 7° C./second, and more preferably, greater than or equal to 10° C./second. The upper limit of the average cooling rate is not particularly limited. Preferably, the upper limit is 40° C./second or less. More preferably, the average cooling rate is less than or equal to 30° C./second.

Note that in instances where the cooling stop temperature is less than 350° C., the average cooling rate over the range from less than 350° C. to the cooling stop temperature is not particularly limited. In such instances, from the standpoint of inhibiting the formation of pearlite and/or bainite, thereby achieving a good yield ratio, it is preferable that the average cooling rate be greater than or equal to 5° C./second and less than or equal to 40° C./second.

Subsequently, the hot-rolled steel sheet or cold-rolled steel sheet is held under the following conditions. First, the hot-rolled steel sheet or cold-rolled steel sheet is held under conditions in which the holding time for the temperature range from 350° C. to 300° C. is less than or equal to 50 seconds. In the temperature range from 350° C. to 300° C., pearlite and/or bainite form, which reduces the martensite having an aspect ratio of 3 or less; consequently, the strength is reduced, and, therefore, the yield ratio is increased. Accordingly, achieving a yield ratio sought by the disclosed embodiments requires that the holding time for the temperature range be short. If the holding time for the temperature range from 350° C. to 300° C. is greater than 50 seconds, pearlite and/or bainite form. For these reasons, the holding time for the temperature range from 350° C. to 300° C. is specified to be less than or equal to 50 seconds. Preferably, the holding time for the temperature range is less than or equal to 45 seconds, and more preferably, less than or equal to 40 seconds. The lower limit of the holding time for the temperature range is not particularly limited and may be 0 seconds. Preferably, the holding time for the temperature range is greater than or equal to 5 seconds, and more preferably, greater than or equal to 8 seconds.

Subsequently, the resulting steel sheet is held under conditions in which the holding time for the temperature range from less than 300° C. to the T1 temperature (° C.) is less than or equal to 1000 seconds. In a temperature range of less than 300° C., pearlite or bainite does not easily form; however, if the holding lasts for a long time, bainite forms, which reduces the martensite having an aspect ratio of 3 or less, and, consequently, the yield ratio is increased. Furthermore, a reason that the T1 temperature (° C.) is a selectable temperature within the temperature range of 200 to 250° C. is that the temperature range in which bainite forms varies depending on the conditions for the annealing step, which include the annealing temperature, the cooling rate, the cooling stop temperature, and the holding time for the temperature range from 350° C. to 300° C. Accordingly, the holding time for the temperature range from less than 300° C. to the T1 temperature (° C.) is specified to be less than or equal to 1000 seconds. Preferably, the holding time is less than or equal to 900 seconds, and more preferably, less than or equal to 800 seconds. The lower limit is not particularly limited and may be 0 seconds. The holding time for the temperature range is preferably greater than or equal to 10 seconds and more preferably greater than or equal to 50 seconds.

Note that in the disclosed embodiments, the hot-rolled steel sheet that has undergone the hot rolling step may be additionally subjected to a heat treatment for softening the structure, before being cold-rolled, and/or the hot-rolled steel sheet that has undergone the hot rolling step or the cold-rolled steel sheet that has undergone the cold rolling step may be subjected to temper rolling for adjusting a shape, after the annealing step.

Furthermore, a coating process may be performed after the annealing step provided that the properties of the steel sheet are not changed.

In instances where a steel sheet having a coating layer is produced, the following process may be used: after the steel sheet is held in the temperature range from less than 300° C. to the T1 temperature (° C.) for 1000 seconds or less in the annealing step described above, the steel sheet, before being cooled, is heated to a temperature range of 400° C. or greater and 500° C. or less, and then a coating process is performed thereon. In addition, an alloying process may be performed thereon after the coating process. In cases where an alloying process is performed, the steel sheet is to be heated to a temperature of greater than 500° C. and 600° C. or less, for example, and then the alloying process is performed thereon. An electrogalvanizing process may be performed after cooling.

For example, in instances where a hot-dip galvanizing process is performed on the annealed steel sheet (hot-rolled steel sheet or cold-rolled steel sheet), it is preferable that the hot-dip galvanizing process be performed by immersing the steel sheet in a galvanizing bath having a temperature of 420° C. or greater and 500° C. or less, and subsequently, the coating weight be adjusted by gas wiping or the like.

Furthermore, in instances where an alloying process is performed on the galvanized coating after the hot-dip galvanizing process, it is preferable that the alloying process be performed within a temperature range of 500° C. or greater and 600° C. or less.

In instances where an electrogalvanizing process is performed on the annealed steel sheet (hot-rolled steel sheet or cold-rolled steel sheet), the electrogalvanizing process is to be performed by immersing the steel sheet in a galvanizing bath or zinc-nickel bath, which has been adjusted to a pH of 1 to 3 at room temperature, and then supplying a current. In this instance, it is preferable that the coating weight be adjusted by adjusting an amount of current, the duration of the electrolysis, and/or the like.

In the above-described production method of the disclosed embodiments, the annealing temperature, the cooling stop temperature, the holding temperature, and the holding time of the annealing step are controlled; consequently, in the microstructure of the obtained high-strength steel sheet, the grain diameter of the martensite, the aspect ratio of the martensite, and the carbon concentration of the martensite are controlled, and, therefore, obtaining a high-strength steel sheet having a low yield ratio is made possible. In addition, the high-strength steel sheet having a low yield ratio of the disclosed embodiments has an excellent surface property and is, therefore, suitable for use in automotive structural members.

EXAMPLES

Example 1

The disclosed embodiments will be described in detail with reference to examples. It will be understood that the disclosed embodiments are not limited to the specific examples described below.

1. Production of Steel Sheets for Evaluation

Steels having the chemical composition shown in Table 1, with the balance being Fe and incidental impurities, were produced in a vacuum melting furnace, and subsequently, the steels were slabbed to form slabs having a thickness of 27 mm. The obtained slabs were hot-rolled to a sheet thickness of 4.0 mm under the conditions shown in Table 2-1 to Table 2-3, and thus, hot-rolled steel sheets were produced. Note that the reduction ratio for the finish rolling was within a range of 80 to 90% for all the conditions. Next, some of the obtained hot-rolled steel sheets were cold-rolled. The samples to be subjected to cold rolling were ones obtained by grinding the hot-rolled steel sheets to a sheet thickness of 3.2 mm. Subsequently, the samples were cold-rolled to a sheet thickness from 2.24 to 0.8 mm under the conditions shown in Table 2-1 to Table 2-3, and thus, cold-rolled steel sheets were produced. Next, each of the hot-rolled steel sheets and the cold-rolled steel sheets obtained as described above was subjected to annealing under the conditions shown in Table 2-1 to Table 2-3, and thus, steel sheets were produced. Note that the blank spaces of Table 1 (spaces with "-" in Table 1) indicate that there was no intentional addition of the element, that is, the element may have been incidentally incorporated, and thus the content may not have been 0 mass %.

TABLE 1

| Steel | Chemical composition (mass %) | | | | | | | | |
|---|---|---|---|---|---|---|---|---|---|
| type | C | Si | Mn | P | S | Al | N | Cr | Mo |
| A | 0.090 | 0.50 | 1.80 | 0.007 | 0.0008 | 0.05 | 0.0021 | — | — |
| B | 0.062 | 0.48 | 1.84 | 0.007 | 0.0009 | 0.05 | 0.0022 | — | — |
| C | 0.067 | 0.49 | 1.82 | 0.008 | 0.0008 | 0.05 | 0.0023 | — | — |
| D | 0.118 | 0.51 | 1.74 | 0.007 | 0.0008 | 0.05 | 0.0022 | — | — |
| E | 0.112 | 0.50 | 1.84 | 0.007 | 0.0007 | 0.05 | 0.0021 | — | — |
| F | 0.088 | 0.67 | 1.76 | 0.007 | 0.0008 | 0.05 | 0.0021 | — | — |
| G | 0.093 | 0.32 | 1.80 | 0.006 | 0.0008 | 0.04 | 0.0031 | — | — |
| H | 0.093 | 0.43 | 1.62 | 0.009 | 0.0045 | 0.04 | 0.0026 | — | — |
| I | 0.102 | 0.51 | 1.66 | 0.007 | 0.0008 | 0.05 | 0.0024 | — | — |
| J | 0.087 | 0.50 | 2.13 | 0.006 | 0.0009 | 0.19 | 0.0033 | — | — |
| K | 0.083 | 0.45 | 2.18 | 0.007 | 0.0008 | 0.04 | 0.0029 | — | — |
| L | 0.089 | 0.42 | 1.88 | 0.007 | 0.0008 | 0.03 | 0.0025 | — | — |
| M | 0.092 | 0.56 | 1.81 | 0.006 | 0.0008 | 0.05 | 0.0023 | 0.04 | — |
| N | 0.095 | 0.51 | 1.76 | 0.007 | 0.0009 | 0.04 | 0.0030 | 0.12 | — |
| O | 0.086 | 0.53 | 1.88 | 0.005 | 0.0007 | 0.05 | 0.0022 | 0.19 | — |
| P | 0.091 | 0.55 | 1.84 | 0.007 | 0.0009 | 0.06 | 0.0033 | — | — |
| Q | 0.096 | 0.50 | 1.74 | 0.006 | 0.0008 | 0.05 | 0.0021 | — | — |
| R | 0.090 | 0.48 | 1.88 | 0.007 | 0.0006 | 0.04 | 0.0025 | — | — |
| S | 0.092 | 0.52 | 1.79 | 0.006 | 0.0007 | 0.05 | 0.0019 | 0.03 | 0.02 |
| T | 0.086 | 0.49 | 1.76 | 0.007 | 0.0009 | 0.18 | 0.0034 | — | — |
| U | 0.088 | 0.46 | 1.87 | 0.009 | 0.0046 | 0.06 | 0.0024 | — | — |
| V | 0.090 | 0.50 | 1.83 | 0.007 | 0.0008 | 0.04 | 0.0027 | — | — |
| W | 0.140 | 0.56 | 1.76 | 0.006 | 0.0008 | 0.05 | 0.0024 | — | — |
| X | 0.053 | 0.48 | 1.88 | 0.007 | 0.0005 | 0.04 | 0.0023 | — | — |
| Y | 0.088 | 0.86 | 1.92 | 0.006 | 0.0009 | 0.05 | 0.0033 | — | — |
| Z | 0.091 | 0.46 | 2.40 | 0.007 | 0.0008 | 0.03 | 0.0025 | — | — |
| AA | 0.093 | 0.51 | 1.49 | 0.006 | 0.0008 | 0.05 | 0.0021 | — | — |
| AB | 0.108 | 0.51 | 1.72 | 0.070 | 0.0008 | 0.05 | 0.0023 | — | — |
| AC | 0.095 | 0.51 | 1.81 | 0.007 | 0.0080 | 0.05 | 0.0019 | — | — |
| AD | 0.102 | 0.51 | 1.71 | 0.007 | 0.0008 | 0.25 | 0.0021 | — | — |
| AE | 0.095 | 0.51 | 1.76 | 0.007 | 0.0009 | 0.04 | 0.0150 | — | — |
| AF | 0.083 | 0.45 | 1.88 | 0.007 | 0.0008 | 0.04 | 0.0029 | 0.25 | — |
| AG | 0.090 | 0.48 | 1.88 | 0.007 | 0.0006 | 0.04 | 0.0025 | — | — |

TABLE 1-continued

| Steel type | Chemical composition (mass %) V | Nb | Ti | Cu | Ni | B | $A_{c1}$ temperature (° C.) | $A_{c3}$ temperature (° C.) |
|---|---|---|---|---|---|---|---|---|
| A | — | — | — | — | — | — | 702 | 841 |
| B | — | — | — | — | — | — | 700 | 848 |
| C | — | — | — | — | — | — | 701 | 848 |
| D | — | — | — | — | — | — | 703 | 834 |
| E | — | — | — | — | — | — | 701 | 833 |
| F | — | — | — | — | — | — | 706 | 851 |
| G | — | — | — | — | — | — | 698 | 827 |
| H | — | — | — | — | — | — | 703 | 837 |
| I | — | — | — | — | — | — | 704 | 842 |
| J | — | — | — | — | — | — | 696 | 896 |
| K | — | — | — | — | — | — | 694 | 825 |
| L | — | — | — | — | — | — | 698 | 826 |
| M | — | — | — | — | — | — | 703 | 843 |
| N | — | — | — | — | — | — | 705 | 837 |
| O | — | — | — | — | — | — | 704 | 843 |
| P | 0.005 | — | — | — | — | — | 702 | 846 |
| Q | 0.020 | — | — | — | — | — | 703 | 843 |
| R | 0.040 | — | — | — | — | — | 700 | 837 |
| S | 0.004 | — | — | — | — | — | 703 | 843 |
| T | — | 0.006 | 0.004 | — | — | — | 702 | 904 |
| U | — | — | — | 0.02 | 0.009 | — | 699 | 842 |
| V | — | — | — | — | — | 0.0006 | 701 | 835 |
| W | — | — | — | — | — | — | 704 | 830 |
| X | — | — | — | — | — | — | 700 | 847 |
| Y | — | — | — | — | — | — | 707 | 854 |
| Z | — | — | — | — | — | — | 690 | 811 |
| AA | — | — | — | — | — | — | 707 | 850 |
| AB | — | — | — | — | — | — | 703 | 838 |
| AC | — | — | — | — | — | — | 702 | 840 |
| AD | — | — | — | — | — | — | 703 | 932 |
| AE | — | — | — | — | — | — | 703 | 836 |
| AF | — | — | — | — | — | — | 703 | 837 |
| AG | 0.060 | — | — | — | — | — | 701 | 839 |

TABLE 2-1

| No. | Steel type | Hot rolling: Slab heating temperature ° C. | Hot rolling: Finishing delivery temperature ° C. | Hot rolling: Coiling temperature ° C. | Cold rolling Reduction ratio % | Annealing conditions: Annealing temperature ° C. | Annealing conditions: Annealing holding time s |
|---|---|---|---|---|---|---|---|
| 1 | A | 1250 | 880 | 650 | 75 | 800 | 35 |
| 2 | | 1250 | 880 | 650 | 75 | 800 | 35 |
| 3 | | 1250 | 880 | 650 | 75 | 800 | 35 |
| 4 | | 1250 | 880 | 650 | 75 | 800 | 35 |
| 5 | | 1250 | 880 | 650 | 75 | 800 | 35 |
| 6 | | 1250 | 880 | 650 | 75 | 800 | 35 |
| 7 | | 1250 | 880 | 650 | 75 | 800 | 35 |
| 8 | | 1250 | 880 | 650 | 75 | 800 | 35 |
| 9 | | 1250 | 880 | 650 | 75 | 720 | 300 |
| 10 | | 1250 | 880 | 650 | 75 | 710 | 100 |
| 11 | B | 1280 | 880 | 650 | 56 | 650 | 35 |
| 12 | | 1280 | 880 | 650 | 56 | 720 | 35 |
| 13 | | 1280 | 880 | 650 | 56 | 800 | 35 |
| 14 | | 1280 | 880 | 650 | 56 | 850 | 35 |
| 15 | C | 1250 | 860 | 650 | 60 | 800 | 150 |
| 16 | | 1250 | 860 | 650 | 60 | 800 | 300 |
| 17 | | 1250 | 860 | 650 | 60 | 800 | 60 |
| 18 | | 1250 | 860 | 650 | 60 | 800 | 20 |
| 19 | D | 1300 | 880 | 650 | 56 | 800 | 35 |
| 20 | | 1300 | 880 | 650 | 56 | 800 | 35 |
| 21 | | 1300 | 880 | 650 | 56 | 800 | 35 |
| 22 | | 1300 | 880 | 650 | 56 | 800 | 35 |
| 23 | E | 1250 | 880 | 670 | 40 | 800 | 35 |
| 24 | | 1250 | 880 | 670 | 30 | 800 | 35 |
| 25 | | 1250 | 880 | 670 | 50 | 800 | 35 |
| 26 | | 1250 | 880 | 670 | 60 | 800 | 35 |
| 27 | F | 1250 | 880 | 650 | 75 | 800 | 35 |
| 28 | | 1250 | 880 | 650 | 75 | 800 | 35 |

TABLE 2-1-continued

| | | | | | | | |
|---|---|---|---|---|---|---|---|
| 29 | | 1250 | 880 | 650 | 75 | 800 | 35 |
| 30 | | 1250 | 880 | 650 | 75 | 800 | 35 |
| 31 | G | 1250 | 900 | 650 | 75 | 800 | 35 |
| 32 | | 1250 | 900 | 650 | 75 | 800 | 35 |
| 33 | | 1250 | 900 | 650 | 75 | 800 | 35 |
| 34 | | 1250 | 900 | 650 | 75 | 800 | 35 |
| 35 | H | 1250 | 880 | 600 | 75 | 650 | 35 |
| 36 | | 1250 | 880 | 600 | 75 | 750 | 35 |
| 37 | | 1250 | 880 | 600 | 75 | 800 | 35 |
| 38 | | 1250 | 880 | 600 | 75 | 850 | 35 |
| 39 | I | 1350 | 880 | 650 | 75 | 800 | 28 |
| 40 | | 1350 | 880 | 650 | 75 | 800 | 80 |
| 41 | | 1350 | 880 | 650 | 75 | 800 | 200 |
| 42 | | 1350 | 880 | 650 | 75 | 800 | 280 |

| | Annealing conditions | | | | |
|---|---|---|---|---|---|
| No. | Average cooling rate *1 ° C./s | Cooling stop temperature ° C. | Holding time for range from 350 to 300° C. s | Holding time for range from less than 300° C. to T1 temperature *2 s | Notes |
| 1 | 15 | 320 | 40 | 300 | Example |
| 2 | 15 | 320 | 30 | 300 | Example |
| 3 | 15 | 320 | 10 | 300 | Example |
| 4 | 15 | 320 | 60 | 300 | Comparative example |
| 5 | 15 | 320 | 40 | 300 | Example |
| 6 | 15 | 320 | 40 | 500 | Example |
| 7 | 15 | 320 | 40 | 700 | Example |
| 8 | 15 | 320 | 40 | 0 | Example |
| 9 | 25 | 260 | 20 | 400 | Example |
| 10 | 25 | 260 | 10 | 100 | Example |
| 11 | 15 | 320 | 40 | 300 | Comparative example |
| 12 | 15 | 320 | 40 | 300 | Example |
| 13 | 15 | 320 | 40 | 300 | Example |
| 14 | 15 | 320 | 40 | 300 | Comparative example |
| 15 | 15 | 320 | 40 | 300 | Example |
| 16 | 15 | 320 | 40 | 300 | Example |
| 17 | 15 | 320 | 40 | 300 | Example |
| 18 | 15 | 320 | 40 | 300 | Comparative example |
| 19 | 15 | 320 | 40 | 300 | Example |
| 20 | 10 | 320 | 40 | 300 | Example |
| 21 | 7 | 320 | 40 | 300 | Example |
| 22 | 3 | 320 | 40 | 300 | Comparative example |
| 23 | 15 | 200 | 0 | 300 | Example |
| 24 | 15 | 250 | 0 | 300 | Example |
| 25 | 15 | 320 | 40 | 300 | Example |
| 26 | 15 | 380 | 40 | 300 | Comparative example |
| 27 | 15 | 320 | 70 | 300 | Comparative example |
| 28 | 15 | 320 | 40 | 300 | Example |
| 29 | 15 | 320 | 30 | 300 | Example |
| 30 | 15 | 320 | 10 | 300 | Example |
| 31 | 15 | 320 | 70 | 200 | Comparative example |
| 32 | 15 | 320 | 40 | 300 | Example |
| 33 | 15 | 320 | 30 | 100 | Example |
| 34 | 15 | 320 | 60 | 100 | Comparative example |
| 35 | 15 | 320 | 40 | 300 | Comparative example |
| 36 | 15 | 320 | 40 | 300 | Example |
| 37 | 15 | 320 | 40 | 300 | Example |
| 38 | 15 | 320 | 40 | 300 | Comparative example |
| 39 | 15 | 320 | 40 | 300 | Comparative example |
| 40 | 15 | 320 | 40 | 300 | Example |
| 41 | 15 | 320 | 40 | 300 | Example |
| 42 | 15 | 320 | 40 | 300 | Example |

*1 The average cooling rate (° C./s) is an average cooling rate over a range from the annealing temperature to 350° C.

*2 The T1 temperature (° C.) is a selectable temperature (° C.) within a temperature range of 200 to 250° C.

TABLE 2-2

| No. | Steel type | Hot rolling: Slab heating temperature ° C. | Hot rolling: Finishing delivery temperature ° C. | Hot rolling: Coiling temperature ° C. | Cold rolling Reduction ratio % | Annealing conditions: Annealing temperature ° C. | Annealing conditions: Annealing holding time s |
|---|---|---|---|---|---|---|---|
| 43 | J | 1250 | 880 | 620 | 70 | 800 | 35 |
| 44 | | 1250 | 880 | 620 | 70 | 800 | 35 |
| 45 | | 1250 | 880 | 620 | 70 | 800 | 35 |
| 46 | | 1250 | 880 | 620 | 70 | 800 | 35 |
| 47 | K | 1250 | 880 | 650 | 70 | 800 | 35 |
| 48 | | 1250 | 880 | 650 | 70 | 800 | 35 |
| 49 | | 1250 | 880 | 650 | 70 | 800 | 35 |
| 50 | | 1250 | 880 | 650 | 70 | 800 | 35 |
| 51 | L | 1250 | 880 | 650 | 70 | 680 | 35 |
| 52 | | 1250 | 880 | 650 | 70 | 740 | 35 |
| 53 | | 1250 | 880 | 650 | 70 | 800 | 35 |
| 54 | | 1250 | 880 | 650 | 70 | 860 | 35 |
| 55 | | 1250 | 880 | 650 | 70 | 800 | 35 |
| 56 | | 1250 | 880 | 650 | 70 | 800 | 35 |
| 57 | | 1250 | 880 | 650 | 70 | 800 | 35 |
| 58 | | 1250 | 880 | 650 | 70 | 800 | 35 |
| 59 | M | 1250 | 920 | 650 | 70 | 800 | 35 |
| 60 | | 1250 | 920 | 650 | 70 | 800 | 35 |
| 61 | | 1250 | 920 | 650 | 70 | 800 | 35 |
| 62 | | 1250 | 920 | 650 | 70 | 800 | 35 |
| 63 | N | 1250 | 880 | 650 | 70 | 800 | 35 |
| 64 | | 1250 | 880 | 650 | 70 | 800 | 35 |
| 65 | | 1250 | 880 | 650 | 70 | 800 | 35 |
| 66 | | 1250 | 880 | 650 | 70 | 800 | 35 |
| 67 | O | 1250 | 880 | 570 | 70 | 710 | 35 |
| 68 | | 1250 | 880 | 570 | 70 | 740 | 35 |
| 69 | | 1250 | 880 | 570 | 70 | 800 | 35 |
| 70 | | 1250 | 880 | 570 | 70 | 840 | 35 |
| 71 | P | 1250 | 880 | 650 | 65 | 800 | 35 |
| 72 | | 1250 | 880 | 650 | 65 | 800 | 35 |
| 73 | | 1250 | 880 | 650 | 65 | 800 | 35 |
| 74 | | 1250 | 880 | 650 | 65 | 800 | 35 |
| 75 | Q | 1250 | 880 | 650 | 65 | 800 | 35 |
| 76 | | 1250 | 880 | 650 | 65 | 800 | 35 |
| 77 | | 1250 | 880 | 650 | 65 | 800 | 35 |
| 78 | | 1250 | 880 | 650 | 65 | 800 | 35 |
| 79 | R | 1250 | 880 | 650 | 65 | 800 | 35 |
| 80 | | 1250 | 880 | 650 | 65 | 800 | 35 |
| 81 | | 1250 | 880 | 650 | 65 | 800 | 35 |
| 82 | | 1250 | 880 | 650 | 65 | 800 | 35 |

| No. | Annealing conditions: Average cooling rate *1 ° C./s | Annealing conditions: Cooling stop temperature ° C. | Annealing conditions: Holding time for range from 350 to 300° C. s | Annealing conditions: Holding time for range from less than 300° C. to T1 temperature *2 s | Notes |
|---|---|---|---|---|---|
| 43 | 30 | 320 | 40 | 300 | Example |
| 44 | 20 | 320 | 40 | 300 | Example |
| 45 | 5 | 320 | 40 | 300 | Example |
| 46 | 2 | 320 | 40 | 300 | Comparative example |
| 47 | 15 | 320 | 40 | 300 | Example |
| 48 | 15 | 300 | 40 | 300 | Example |
| 49 | 15 | 340 | 40 | 300 | Example |
| 50 | 15 | 370 | 40 | 300 | Comparative example |
| 51 | 15 | 320 | 40 | 300 | Comparative example |
| 52 | 15 | 320 | 40 | 300 | Example |
| 53 | 15 | 320 | 40 | 300 | Example |
| 54 | 15 | 320 | 40 | 300 | Comparative example |
| 55 | 15 | 270 | 0 | 300 | Example |
| 56 | 15 | 320 | 40 | 300 | Example |
| 57 | 15 | 370 | 40 | 300 | Comparative example |
| 58 | 15 | 400 | 40 | 300 | Comparative example |
| 59 | 15 | 320 | 40 | 300 | Example |
| 60 | 15 | 320 | 20 | 300 | Example |
| 61 | 15 | 320 | 60 | 300 | Comparative example |
| 62 | 15 | 320 | 80 | 300 | Comparative example |
| 63 | 15 | 320 | 40 | 300 | Example |
| 64 | 15 | 320 | 40 | 500 | Example |

TABLE 2-2-continued

| | | | | | |
|---|---|---|---|---|---|
| 65 | 15 | 320 | 40 | 200 | Example |
| 66 | 15 | 320 | 40 | 100 | Example |
| 67 | 15 | 320 | 40 | 300 | Example |
| 68 | 15 | 320 | 40 | 300 | Example |
| 69 | 15 | 320 | 40 | 300 | Example |
| 70 | 15 | 320 | 40 | 300 | Example |
| 71 | 15 | 370 | 40 | 300 | Comparative example |
| 72 | 15 | 340 | 40 | 300 | Example |
| 73 | 15 | 320 | 40 | 300 | Example |
| 74 | 15 | 280 | 0 | 300 | Example |
| 75 | 15 | 320 | 50 | 300 | Example |
| 76 | 15 | 320 | 40 | 300 | Example |
| 77 | 15 | 320 | 30 | 300 | Example |
| 78 | 15 | 320 | 60 | 300 | Comparative example |
| 79 | 15 | 320 | 40 | 300 | Example |
| 80 | 15 | 320 | 40 | 0 | Example |
| 81 | 15 | 320 | 40 | 230 | Example |
| 82 | 15 | 320 | 40 | 250 | Example |

*1 The average cooling rate (° C./s) is an average cooling rate over a range from the annealing temperature to 350° C.
*2 The T1 temperature (° C.) is a selectable temperature (° C.) within a temperature range of 200 to 250° C.

TABLE 2-3

| | | Hot rolling | | | | Annealing conditions | |
|---|---|---|---|---|---|---|---|
| No. | Steel type | Slab heating temperature ° C. | Finishing delivery temperature ° C. | Coiling temperature ° C. | Cold rolling Reduction ratio % | Annealing temperature ° C. | Annealing holding time s |
| 83 | S | 1200 | 880 | 650 | 56 | 800 | 35 |
| 84 | | 1220 | 880 | 650 | 56 | 800 | 35 |
| 85 | | 1240 | 880 | 650 | 56 | 800 | 35 |
| 86 | | 1250 | 880 | 650 | 56 | 800 | 35 |
| 87 | T | 1250 | 840 | 650 | 56 | 800 | 35 |
| 88 | | 1250 | 850 | 650 | 56 | 800 | 35 |
| 89 | | 1250 | 880 | 650 | 56 | 800 | 35 |
| 90 | | 1250 | 920 | 650 | 56 | 800 | 35 |
| 91 | U | 1250 | 880 | 700 | 56 | 800 | 35 |
| 92 | | 1250 | 880 | 650 | 56 | 800 | 35 |
| 93 | | 1250 | 880 | 600 | 56 | 800 | 35 |
| 94 | | 1250 | 880 | 550 | 56 | 800 | 35 |
| 95 | V | 1250 | 880 | 650 | — | 800 | 35 |
| 96 | | 1250 | 880 | 650 | — | 750 | 200 |
| 97 | | 1250 | 880 | 650 | — | 800 | 35 |
| 98 | | 1250 | 880 | 650 | — | 800 | 35 |
| 99 | W | 1250 | 880 | 650 | 56 | 800 | 35 |
| 100 | X | 1250 | 880 | 650 | 56 | 800 | 35 |
| 101 | Y | 1250 | 880 | 650 | 56 | 800 | 35 |
| 102 | Z | 1250 | 880 | 650 | 56 | 800 | 35 |
| 103 | AA | 1250 | 880 | 650 | 56 | 800 | 35 |
| 104 | AB | 1250 | 880 | 650 | 56 | 800 | 35 |
| 105 | AC | 1250 | 880 | 650 | 56 | 800 | 35 |
| 106 | AD | 1250 | 880 | 650 | 56 | 800 | 35 |
| 107 | AE | 1250 | 880 | 650 | 56 | 800 | 35 |
| 108 | AF | 1250 | 880 | 650 | 56 | 800 | 35 |
| 109 | AG | 1250 | 880 | 650 | 56 | 800 | 35 |

| | Annealing conditions | | | | |
|---|---|---|---|---|---|
| No. | Average cooling rate *1 ° C./s | Cooling stop temperature ° C. | Holding time for range from 350 to 300° C. s | Holding time for range from less than 300° C. to T1 temperature *2 s | Notes |
| 83 | 15 | 320 | 40 | 300 | Example |
| 84 | 15 | 320 | 40 | 300 | Example |
| 85 | 15 | 320 | 40 | 300 | Example |
| 86 | 15 | 320 | 40 | 300 | Example |
| 87 | 15 | 320 | 40 | 300 | Example |
| 88 | 15 | 320 | 40 | 300 | Example |
| 89 | 15 | 320 | 40 | 300 | Example |
| 90 | 15 | 320 | 40 | 300 | Example |
| 91 | 15 | 320 | 40 | 300 | Example |

TABLE 2-3-continued

| | | | | | |
|---|---|---|---|---|---|
| 92 | 15 | 320 | 40 | 300 | Example |
| 93 | 15 | 320 | 40 | 300 | Example |
| 94 | 15 | 320 | 40 | 300 | Example |
| 95 | 15 | 320 | 10 | 300 | Example |
| 96 | 15 | 320 | 40 | 100 | Example |
| 97 | 15 | 260 | 40 | 300 | Example |
| 98 | 25 | 320 | 40 | 400 | Example |
| 99 | 15 | 320 | 40 | 300 | Comparative example |
| 100 | 15 | 320 | 40 | 300 | Comparative example |
| 101 | 15 | 320 | 40 | 300 | Comparative example |
| 102 | 15 | 320 | 40 | 300 | Comparative example |
| 103 | 15 | 320 | 40 | 300 | Comparative example |
| 104 | 15 | 320 | 40 | 300 | Comparative example |
| 105 | 15 | 320 | 40 | 300 | Comparative example |
| 106 | 15 | 320 | 40 | 300 | Comparative example |
| 107 | 15 | 320 | 40 | 300 | Comparative example |
| 108 | 15 | 320 | 40 | 300 | Comparative example |
| 109 | 15 | 320 | 40 | 300 | Comparative example |

*1 The average cooling rate (° C./s) is an average cooling rate over a range from the annealing temperature to 350° C.
*2 The T1 temperature (° C.) is a selectable temperature (° C.) within a temperature range of 200 to 250° C.

2. Evaluation Methods

The steel sheets produced under different production conditions were subjected to a microstructure analysis, by which the fractions of the constituents were investigated, and to a tensile test, by which mechanical properties such as a tensile strength were evaluated. The investigation of the fractions of the constituents and the evaluations were performed in the following manners.

<Area Fractions of Ferrite and Martensite>

Ferrite and martensite were examined as follows: a test piece was cut from each of the steel sheets, along a rolling direction and a direction perpendicular to the rolling direction, and a sheet thickness L cross section thereof, which was parallel to the rolling direction, was mirror-polished and etched with a nital solution to reveal the microstructure, which was then examined with a scanning electron microscope (SEM). In an SEM image at a magnification of 1500×, a 16×15 grid with a 4.8-μm spacing was placed on a region of 82 μm×57 μm (actual lengths), and area fractions of ferrite and martensite were investigated (measured) by using a point counting method, in which the number of points lying on each of the phases is counted. The area fractions were each an average of three area fractions determined from separate SEM images at a magnification of 1500×. The martensite is a constituent that appeared to be white, and the ferrite is a constituent that appeared to be black.

Note that the microstructure of steel sheets of the disclosed embodiments is uniform in a sheet thickness direction across sheet thickness positions, excluding a region extending 10 μm from a surface layer in the sheet thickness direction. Accordingly, regarding sheet thickness measurement positions, measurements may be performed at any position within the region in which the microstructure is uniform. In the disclosed embodiments, the microstructure was examined at a ¼ sheet thickness position in the sheet thickness direction.

<Average Grain Diameter of Martensite and Aspect Ratio of Martensite>

The average grain diameter of the martensite and an aspect ratio of the martensite were examined as follows: a test piece was cut from each of the steel sheets, along the rolling direction and the direction perpendicular to the rolling direction, and a sheet thickness L cross section thereof, which was parallel to the rolling direction, was mirror-polished and etched with a nital solution to reveal the microstructure, which was then examined with a scanning electron microscope. All major dimensions and all minor dimensions of the martensite within an SEM image at a magnification of 1500× were measured, and an average of the measurements was calculated and designated as the average grain diameter of the martensite. Furthermore, the aspect ratio of the martensite was calculated by dividing the measured major dimension by the measured minor dimension.

Note that the microstructure of steel sheets of the disclosed embodiments is uniform in the sheet thickness direction across sheet thickness positions, excluding a region extending 10 μm from a surface layer in the sheet thickness direction. Accordingly, regarding sheet thickness measurement positions, measurements may be performed at any position within the region in which the microstructure is uniform. In the disclosed embodiments, the microstructure was examined at a ¼ sheet thickness position in the sheet thickness direction.

<Carbon Concentration of Martensite Having Aspect Ratio of 3 or Less>

The carbon concentration of the martensite was measured by X-ray diffraction analysis as follows: after each of the steel sheets was ground to a ¼ sheet thickness position thereof, a test piece was cut, and a sheet thickness L cross section thereof, which was parallel to the rolling direction, was mirror-polished and used. The X-ray used was Co-Kα radiation. In the disclosed embodiments, a region of 22.5 μm×22.5 μm was measured for three fields of view by using an electron probe microanalyzer (EPMA) under conditions including an acceleration voltage of 7 kV and a distance between measurement points of 80 nm, and the measured data was converted into a C concentration by using a standard curve method. Simultaneously acquired SEM images, which were acquired with an in-lens detector, were used for a comparison to distinguish types of martensite, and an average of the carbon concentrations of martensite having an aspect ratio of 3 or less within the measurement field of view was calculated for three fields of view, and the values were averaged to accomplish the calculation.

Note that the microstructure of steel sheets of the disclosed embodiments is uniform in the sheet thickness direction across sheet thickness positions, excluding a region extending 10 μm from a surface layer in the sheet thickness direction. Accordingly, regarding sheet thickness measurement positions, measurements may be performed at any position within the region in which the microstructure is uniform. In the disclosed embodiments, the microstructure was examined at a ¼ sheet thickness position in the sheet thickness direction.

<Area Fractions of Remaining Constituents>

The remaining constituents described above were examined as follows: a test piece was cut from each of the steel sheets, along the rolling direction and the direction perpendicular to the rolling direction, and a sheet thickness L cross section thereof, which was parallel to the rolling direction, was mirror-polished and etched with a nital solution to reveal the microstructure, which was then examined with a scanning electron microscope. In an SEM image at a magnification of 1500×, a 16×15 grid with a 4.8-μm spacing was placed on a region of 82 μm×57 μm (actual lengths), and area fractions of the remaining constituents were investigated (measured) by using the point counting method, in which the number of points lying on each of the phases is counted. The area fractions were each an average of three area fractions determined from separate SEM images at a magnification of 1500×. Pearlite is a constituent containing ferrite and cementite precipitated therein in a lamellar form, bainite is a constituent containing ferrite and cementite precipitated therein in a globular form, and retained austenite is a constituent that appeared to be black.

Note that the microstructure of steel sheets of the disclosed embodiments is uniform in the sheet thickness direction across sheet thickness positions, excluding a region extending 10 μm from a surface layer in the sheet thickness direction. Accordingly, regarding sheet thickness measurement positions, measurements may be performed at any position within the region in which the microstructure is uniform. In the disclosed embodiments, the microstructure was examined at a ¼ sheet thickness position in the sheet thickness direction.

<Mechanical Properties>

A JIS No. 5 test piece with a gauge length of 50 mm, a gauge width of 25 mm, and a sheet thickness of 1.4 mm was cut from each of the steel sheets along the rolling direction, and a tensile test was conducted at a cross head speed of 10 mm/minute. By using each of the test pieces, the tensile strength (denoted as "TS" in Table 3-1 to Table 3-3) and the yield strength (denoted as "YS" in Table 3-1 to Table 3-3) were measured. The yield ratio (denoted as "YR" in Table 3-1 to Table 3-3) was calculated by dividing YS by TS.

<Chemical Convertibility>

Each of the steel sheets was degreased with a commercially available alkaline degreasing agent, the steel sheet was then immersed in a surface modifying agent, and subsequently, chemical conversion was performed in which the steel sheet was immersed in a phosphating agent (PALBOND PB-L3080, manufactured by Nihon Parkerizing Co., Ltd.) under conditions including a bath temperature of 40° C. and a process time of 120 seconds. The coverage ratio of conversion crystals was calculated by visually inspecting the surface of the steel sheet that had undergone the chemical conversion. Instances in which the coating ratio of conversion crystals, which was a ratio in terms of an area fraction, was 95% or greater were indicated by a symbol "○", instances in which the coating ratio was 90% or greater and less than 95% were indicated by a symbol "Δ", and instances in which the coating ratio was less than 90% were indicated by a symbol "×". It was determined that the instances with the symbol "○" or "Δ" represented instances in which uniform conversion crystals were formed, and, therefore, good chemical convertibility was exhibited.

3. Evaluation Results

The results of the investigations and evaluations described above are shown in Table 3-1 to Table 3-3.

TABLE 3-1

| | | Microstructure | | | | |
|---|---|---|---|---|---|---|
| No. | Steel type | Ferrite area % | Martensite area % | Average grain diameter of martensite μm | Martensite having aspect ratio of 3 or less/entire martensite % | C concentration of martensite having aspect ratio of 3 or less mass % |
| 1 | A | 66 | 30 | 2.4 | 70 | 0.43 |
| 2 | | 60 | 35 | 2.3 | 75 | 0.35 |
| 3 | | 63 | 35 | 2.9 | 75 | 0.42 |
| 4 | | 67 | 25 | 3.0 | 55 | 0.56 |
| 5 | | 66 | 30 | 2.9 | 70 | 0.44 |
| 6 | | 55 | 40 | 2.5 | 70 | 0.37 |
| 7 | | 53 | 40 | 2.4 | 80 | 0.42 |
| 8 | | 53 | 45 | 2.3 | 60 | 0.51 |
| 9 | | 88 | 12 | 1.8 | 85 | 0.88 |
| 10 | | 70 | 30 | 2.1 | 100 | 0.83 |
| 11 | B | 88 | 8 | 2.4 | 95 | 1.00 |
| 12 | | 80 | 15 | 2.7 | 70 | 0.66 |
| 13 | | 61 | 35 | 3.0 | 70 | 0.49 |
| 14 | | 40 | 55 | 3.3 | 65 | 0.21 |
| 15 | C | 68 | 30 | 2.2 | 70 | 0.45 |
| 16 | | 64 | 35 | 2.8 | 70 | 0.33 |
| 17 | | 66 | 30 | 2.4 | 70 | 0.40 |
| 18 | | 63 | 30 | 2.0 | 50 | 0.23 |
| 19 | D | 60 | 35 | 2.4 | 70 | 0.46 |
| 20 | | 56 | 40 | 2.6 | 70 | 0.45 |
| 21 | | 58 | 35 | 2.7 | 60 | 0.38 |
| 22 | | 57 | 35 | 2.0 | 55 | 0.43 |
| 23 | E | 63 | 35 | 2.4 | 70 | 0.43 |
| 24 | | 64 | 35 | 3.0 | 70 | 0.34 |
| 25 | | 55 | 40 | 2.6 | 70 | 0.41 |
| 26 | | 56 | 40 | 2.7 | 50 | 0.42 |
| 27 | F | 63 | 30 | 2.9 | 50 | 0.38 |
| 28 | | 61 | 35 | 2.6 | 70 | 0.43 |
| 29 | | 60 | 35 | 2.6 | 80 | 0.40 |
| 30 | | 63 | 35 | 2.7 | 85 | 0.34 |

TABLE 3-1-continued

| | | | | | | |
|---|---|---|---|---|---|---|
| 31 | G | 58 | 35 | 2.4 | 55 | 0.45 |
| 32 | | 66 | 30 | 2.0 | 70 | 0.45 |
| 33 | | 63 | 35 | 2.0 | 65 | 0.38 |
| 34 | | 57 | 35 | 2.4 | 40 | 0.42 |
| 35 | H | 88 | 7 | 1.8 | 70 | 0.96 |
| 36 | | 83 | 13 | 2.2 | 70 | 0.84 |
| 37 | | 60 | 35 | 2.4 | 70 | 0.46 |
| 38 | | 41 | 55 | 3.4 | 70 | 0.22 |
| 39 | | 63 | 30 | 2.0 | 55 | 0.25 |
| 40 | | 65 | 30 | 2.9 | 65 | 0.34 |
| 41 | | 63 | 35 | 2.4 | 70 | 0.40 |
| 42 | | 74 | 25 | 2.7 | 75 | 0.45 |

| | Microstructure Remaining constituents | Mechanical properties | | | | |
|---|---|---|---|---|---|---|
| No. | *1 area % | YS MPa | TS MPa | YR | Chemical convertibility | Notes |
| 1 | 4 | 378 | 638 | 0.59 | ○ | Example |
| 2 | 5 | 360 | 642 | 0.56 | ○ | Example |
| 3 | 2 | 351 | 640 | 0.55 | ○ | Example |
| 4 | 8 | 410 | 641 | 0.64 | ○ | Comparative example |
| 5 | 4 | 346 | 638 | 0.54 | ○ | Example |
| 6 | 5 | 362 | 642 | 0.56 | ○ | Example |
| 7 | 7 | 331 | 639 | 0.52 | ○ | Example |
| 8 | 2 | 390 | 640 | 0.61 | ○ | Example |
| 9 | 0 | 303 | 621 | 0.49 | ○ | Example |
| 10 | 0 | 326 | 638 | 0.51 | ○ | Example |
| 11 | 4 | 360 | 563 | 0.64 | ○ | Comparative example |
| 12 | 5 | 377 | 617 | 0.61 | ○ | Example |
| 13 | 4 | 335 | 614 | 0.55 | ○ | Example |
| 14 | 5 | 395 | 616 | 0.64 | ○ | Comparative example |
| 15 | 2 | 349 | 618 | 0.56 | ○ | Example |
| 16 | 1 | 380 | 622 | 0.61 | ○ | Example |
| 17 | 4 | 354 | 620 | 0.57 | ○ | Example |
| 18 | 7 | 405 | 621 | 0.65 | ○ | Comparative example |
| 19 | 5 | 376 | 678 | 0.55 | ○ | Example |
| 20 | 4 | 360 | 682 | 0.53 | ○ | Example |
| 21 | 7 | 370 | 680 | 0.54 | ○ | Example |
| 22 | 8 | 445 | 681 | 0.65 | ○ | Comparative example |
| 23 | 2 | 349 | 693 | 0.50 | ○ | Example |
| 24 | 1 | 361 | 697 | 0.52 | ○ | Example |
| 25 | 5 | 338 | 694 | 0.49 | ○ | Example |
| 26 | 4 | 465 | 695 | 0.67 | ○ | Comparative example |
| 27 | 7 | 407 | 618 | 0.66 | ○ | Comparative example |
| 28 | 4 | 358 | 622 | 0.58 | ○ | Example |
| 29 | 5 | 334 | 619 | 0.54 | ○ | Example |
| 30 | 2 | 360 | 620 | 0.58 | ○ | Example |
| 31 | 7 | 411 | 643 | 0.64 | ○ | Comparative example |
| 32 | 4 | 366 | 647 | 0.57 | ○ | Example |
| 33 | 2 | 357 | 644 | 0.55 | ○ | Example |
| 34 | 8 | 426 | 645 | 0.66 | ○ | Comparative example |
| 35 | 5 | 360 | 518 | 0.69 | ○ | Comparative example |
| 36 | 4 | 334 | 602 | 0.55 | ○ | Example |
| 37 | 5 | 373 | 599 | 0.62 | ○ | Example |
| 38 | 4 | 385 | 600 | 0.64 | ○ | Comparative example |
| 39 | 7 | 410 | 618 | 0.66 | ○ | Comparative example |
| 40 | 5 | 368 | 622 | 0.59 | ○ | Example |
| 41 | 2 | 363 | 619 | 0.59 | ○ | Example |
| 42 | 1 | 333 | 620 | 0.54 | ○ | Example |

*1 The remaining constituents are one or more of retained austenite, bainite, and pearlite.

TABLE 3-2

| | | Microstructure | | | | |
|---|---|---|---|---|---|---|
| No. | Steel type | Ferrite area % | Martensite area % | Average grain diameter of martensite μm | Martensite having aspect ratio of 3 or less/entire martensite % | C concentration of martensite having aspect ratio of 3 or less mass % |
| 43 | J | 68 | 30 | 2.4 | 70 | 0.47 |
| 44 | | 64 | 35 | 2.4 | 70 | 0.34 |
| 45 | | 53 | 40 | 2.2 | 65 | 0.48 |
| 46 | | 52 | 40 | 2.4 | 50 | 0.44 |

TABLE 3-2-continued

| | | | | | | |
|---|---|---|---|---|---|---|
| 47 | K | 61 | 35 | 2.6 | 70 | 0.35 |
| 48 | | 55 | 40 | 2.1 | 75 | 0.45 |
| 49 | | 56 | 40 | 2.0 | 65 | 0.48 |
| 50 | | 60 | 35 | 3.0 | 55 | 0.40 |
| 51 | L | 86 | 8 | 2.0 | 80 | 0.98 |
| 52 | | 81 | 15 | 2.2 | 70 | 0.76 |
| 53 | | 55 | 40 | 2.4 | 70 | 0.48 |
| 54 | | 37 | 60 | 3.5 | 60 | 0.23 |
| 55 | | 68 | 30 | 2.8 | 70 | 0.46 |
| 56 | | 66 | 30 | 2.2 | 70 | 0.44 |
| 57 | | 65 | 30 | 2.9 | 55 | 0.45 |
| 58 | | 61 | 35 | 2.7 | 50 | 0.36 |
| 59 | M | 60 | 35 | 2.4 | 70 | 0.40 |
| 60 | | 58 | 40 | 2.1 | 70 | 0.48 |
| 61 | | 58 | 35 | 2.7 | 50 | 0.35 |
| 62 | | 57 | 35 | 2.9 | 50 | 0.46 |
| 63 | N | 56 | 40 | 2.4 | 70 | 0.46 |
| 64 | | 60 | 35 | 2.4 | 80 | 0.48 |
| 65 | | 56 | 40 | 2.2 | 65 | 0.34 |
| 66 | | 63 | 35 | 2.5 | 65 | 0.45 |
| 67 | O | 80 | 15 | 2.3 | 70 | 0.72 |
| 68 | | 71 | 25 | 2.6 | 70 | 0.51 |
| 69 | | 65 | 30 | 2.8 | 70 | 0.44 |
| 70 | | 59 | 35 | 3.0 | 70 | 0.42 |
| 71 | P | 62 | 35 | 2.8 | 55 | 0.40 |
| 72 | | 51 | 45 | 2.5 | 65 | 0.35 |
| 73 | | 60 | 35 | 2.1 | 70 | 0.48 |
| 74 | | 58 | 40 | 2.0 | 75 | 0.47 |
| 75 | Q | 56 | 40 | 3.0 | 65 | 0.47 |
| 76 | | 55 | 40 | 2.0 | 70 | 0.35 |
| 77 | | 51 | 45 | 2.3 | 70 | 0.46 |
| 78 | | 53 | 40 | 2.5 | 50 | 0.43 |
| 79 | R | 60 | 35 | 2.2 | 70 | 0.45 |
| 80 | | 66 | 30 | 2.8 | 60 | 0.43 |
| 81 | | 55 | 40 | 2.6 | 65 | 0.34 |
| 82 | | 66 | 30 | 2.8 | 70 | 0.48 |

| | Microstructure Remaining constituents | Mechanical properties | | | | |
|---|---|---|---|---|---|---|
| No. | *1 area % | YS MPa | TS MPa | YR | Chemical convertibility | Notes |
| 43 | 2 | 333 | 668 | 0.50 | Δ | Example |
| 44 | 1 | 332 | 672 | 0.49 | Δ | Example |
| 45 | 7 | 359 | 669 | 0.54 | Δ | Example |
| 46 | 8 | 435 | 671 | 0.65 | Δ | Comparative example |
| 47 | 4 | 360 | 678 | 0.53 | Δ | Example |
| 48 | 5 | 346 | 682 | 0.51 | Δ | Example |
| 49 | 4 | 364 | 679 | 0.54 | Δ | Example |
| 50 | 5 | 435 | 680 | 0.64 | Δ | Comparative example |
| 51 | 6 | 366 | 568 | 0.64 | ○ | Comparative example |
| 52 | 4 | 345 | 662 | 0.52 | ○ | Example |
| 53 | 5 | 363 | 659 | 0.55 | ○ | Example |
| 54 | 3 | 453 | 660 | 0.69 | ○ | Comparative example |
| 55 | 2 | 375 | 658 | 0.57 | ○ | Example |
| 56 | 4 | 346 | 662 | 0.52 | ○ | Example |
| 57 | 5 | 423 | 659 | 0.64 | ○ | Comparative example |
| 58 | 4 | 426 | 661 | 0.64 | ○ | Comparative example |
| 59 | 5 | 353 | 648 | 0.54 | Δ | Example |
| 60 | 2 | 367 | 652 | 0.56 | Δ | Example |
| 61 | 7 | 418 | 649 | 0.64 | Δ | Comparative example |
| 62 | 8 | 425 | 651 | 0.65 | Δ | Comparative example |
| 63 | 4 | 353 | 638 | 0.55 | Δ | Example |
| 64 | 5 | 352 | 642 | 0.55 | Δ | Example |
| 65 | 4 | 374 | 639 | 0.59 | Δ | Example |
| 66 | 2 | 400 | 641 | 0.62 | Δ | Example |
| 67 | 5 | 377 | 613 | 0.62 | Δ | Example |
| 68 | 4 | 372 | 632 | 0.59 | Δ | Example |
| 69 | 5 | 339 | 649 | 0.52 | Δ | Example |
| 70 | 6 | 364 | 656 | 0.55 | Δ | Example |
| 71 | 3 | 420 | 653 | 0.64 | Δ | Comparative example |
| 72 | 4 | 330 | 657 | 0.50 | Δ | Example |
| 73 | 5 | 380 | 654 | 0.58 | Δ | Example |
| 74 | 2 | 346 | 656 | 0.53 | Δ | Example |
| 75 | 4 | 380 | 633 | 0.60 | Δ | Example |
| 76 | 5 | 353 | 638 | 0.55 | Δ | Example |
| 77 | 4 | 361 | 634 | 0.57 | Δ | Example |
| 78 | 7 | 413 | 636 | 0.65 | Δ | Comparative example |

TABLE 3-2-continued

| | | | | | | |
|---|---|---|---|---|---|---|
| 79 | 5 | 332 | 663 | 0.50 | Δ | Example |
| 80 | 4 | 332 | 667 | 0.50 | Δ | Example |
| 81 | 5 | 365 | 664 | 0.55 | Δ | Example |
| 82 | 4 | 350 | 666 | 0.53 | Δ | Example |

*1 The remaining constituents are one or more of retained austenite, bainite, and pearlite.

TABLE 3-3

| | | Microstructure | | | | |
|---|---|---|---|---|---|---|
| No. | Steel type | Ferrite area % | Martensite area % | Average grain diameter of martensite μm | Martensite having aspect ratio of 3 or less/entire martensite % | C concentration of martensite having aspect ratio of 3 or less mass % |
| 83 | S | 60 | 35 | 2.9 | 70 | 0.42 |
| 84 | | 61 | 35 | 2.6 | 70 | 0.40 |
| 85 | | 65 | 30 | 2.0 | 70 | 0.37 |
| 86 | | 59 | 35 | 2.2 | 70 | 0.43 |
| 87 | T | 67 | 30 | 2.7 | 70 | 0.42 |
| 88 | | 66 | 30 | 3.0 | 70 | 0.41 |
| 89 | | 65 | 30 | 2.6 | 70 | 0.43 |
| 90 | | 66 | 30 | 2.7 | 70 | 0.35 |
| 91 | U | 59 | 35 | 2.9 | 70 | 0.49 |
| 92 | | 65 | 30 | 2.8 | 70 | 0.45 |
| 93 | | 66 | 30 | 2.0 | 70 | 0.48 |
| 94 | | 55 | 40 | 2.2 | 70 | 0.33 |
| 95 | V | 57 | 40 | 2.6 | 70 | 0.47 |
| 96 | | 74 | 25 | 2.2 | 70 | 0.44 |
| 97 | | 56 | 40 | 2.2 | 65 | 0.47 |
| 98 | | 63 | 35 | 2.6 | 65 | 0.42 |
| 99 | W | 40 | 55 | 2.2 | 70 | 0.66 |
| 100 | X | 61 | 35 | 2.1 | 70 | 0.43 |
| 101 | Y | 55 | 40 | 2.1 | 70 | 0.48 |
| 102 | Z | 51 | 45 | 2.8 | 70 | 0.40 |
| 103 | AA | 70 | 25 | 2.9 | 70 | 0.37 |
| 104 | AB | 66 | 30 | 2.1 | 70 | 0.43 |
| 105 | AC | 59 | 35 | 2.1 | 70 | 0.45 |
| 106 | AD | 62 | 35 | 2.5 | 70 | 0.26 |
| 107 | AE | 65 | 30 | 2.4 | 70 | 0.37 |
| 108 | AF | 56 | 40 | 2.6 | 70 | 0.43 |
| 109 | AG | 50 | 45 | 2.3 | 70 | 0.46 |

| | Microstructure Remaining constituents | Mechanical properties | | | | |
|---|---|---|---|---|---|---|
| No. | *1 area % | YS MPa | TS MPa | YR | Chemical convertibility | Notes |
| 83 | 5 | 347 | 638 | 0.54 | Δ | Example |
| 84 | 4 | 377 | 642 | 0.59 | Δ | Example |
| 85 | 5 | 349 | 639 | 0.55 | Δ | Example |
| 86 | 6 | 371 | 641 | 0.58 | Δ | Example |
| 87 | 3 | 356 | 618 | 0.58 | Δ | Example |
| 88 | 4 | 360 | 622 | 0.58 | Δ | Example |
| 89 | 5 | 365 | 619 | 0.59 | Δ | Example |
| 90 | 4 | 331 | 621 | 0.53 | Δ | Example |
| 91 | 6 | 378 | 658 | 0.57 | Δ | Example |
| 92 | 5 | 362 | 662 | 0.55 | Δ | Example |
| 93 | 4 | 371 | 659 | 0.56 | Δ | Example |
| 94 | 5 | 333 | 661 | 0.50 | Δ | Example |
| 95 | 3 | 337 | 648 | 0.52 | Δ | Example |
| 96 | 1 | 379 | 652 | 0.58 | Δ | Example |
| 97 | 4 | 372 | 649 | 0.57 | Δ | Example |
| 98 | 2 | 356 | 651 | 0.55 | Δ | Example |
| 99 | 5 | 480 | 728 | 0.66 | ○ | Comparative example |
| 100 | 4 | 361 | 582 | 0.62 | ○ | Comparative example |
| 101 | 5 | 445 | 668 | 0.67 | x | Comparative example |
| 102 | 4 | 360 | 761 | 0.47 | x | Comparative example |
| 103 | 5 | 365 | 549 | 0.66 | ○ | Comparative example |
| 104 | 4 | 438 | 672 | 0.65 | ○ | Comparative example |
| 105 | 6 | 420 | 648 | 0.65 | ○ | Comparative example |
| 106 | 3 | 414 | 641 | 0.65 | ○ | Comparative example |
| 107 | 5 | 427 | 639 | 0.67 | ○ | Comparative example |

TABLE 3-3-continued

| | | | | | | |
|---|---|---|---|---|---|---|
| 108 | 4 | 371 | 652 | 0.57 | x | Comparative example |
| 109 | 5 | 378 | 663 | 0.57 | x | Comparative example |

*1 The remaining constituents are one or more of retained austenite, bainite, and peadite.

In Example 1, steel sheets having a TS of 590 MPa or greater, a YR of 0.63 or less, and good chemical convertibility were rated as "pass" and are indicated as "Example" in the "Notes" column in Table 3-1 to Table 3-3. On the other hand, steel sheets having at least one of a TS of less than 590 MPa, a YR of greater than 0.63, and low chemical convertibility were rated as "fail" and are indicated as "Comparative Example" in the "Notes" column in Table 3-1 to Table 3-3.

Example 2

1. Production of Steel Sheets for Evaluation

Hot-rolled steel sheets produced by hot rolling and cold-rolled steel sheets produced by hot rolling and subsequent cold rolling were annealed under the conditions shown in Table 4; the steels that were rolled were those of Steel Type A, F, or Y shown in Table 1. The annealed steel sheets were subjected to a galvanizing process, and thus, coated steel sheets were produced. Note that the reduction ratio for the finish rolling in the hot rolling was within a range of 80 to 90% for all the conditions. In Table 4, "GI" denotes a galvanized steel sheet, "GA" denotes a galvannealed steel sheet, and "EG" denotes an electrogalvanized steel sheet.

Regarding the galvanized steel sheet, in performing the hot-dip galvanizing process on the annealed steel sheet (hot-rolled steel sheet or cold-rolled steel sheet), the hot-dip galvanizing process was performed by immersing the steel sheet in a galvanizing bath having a temperature of 420° C. or greater and 500° C. or less, and subsequently, the coating weight was adjusted by gas wiping or the like.

Furthermore, regarding the galvannealed steel sheet, in performing the alloying process on the galvanized coating after the hot-dip galvanizing process, the alloying process was carried out within a temperature range of 500° C. or greater and 600° C. or less.

Furthermore, regarding the electrogalvanized steel sheet, in performing the electrogalvanizing process on the annealed steel sheet (hot-rolled steel sheet or cold-rolled steel sheet), the electrogalvanizing process was performed by immersing the steel sheet in a galvanizing bath or zinc-nickel bath, which had been adjusted to a pH of 1 to 3 at room temperature, and then supplying a current.

TABLE 4

| | | Hot rolling | | | | Annealing conditions | | |
|---|---|---|---|---|---|---|---|---|
| No. | Steel type | Slab heating temperature ° C. | Finishing delivery temperature ° C. | Coiling temperature ° C. | Cold rolling Reduction ratio % | Annealing temperature ° C. | Annealing holding time s | Average cooling rate *1 ° C./s |
| 1 | A | 1250 | 880 | 650 | 75 | 800 | 35 | 15 |
| 2 | | 1250 | 880 | 650 | 75 | 790 | 35 | 15 |
| 3 | | 1250 | 880 | 650 | 75 | 800 | 35 | 15 |
| 4 | | 1250 | 880 | 650 | 75 | 770 | 35 | 15 |
| 5 | | 1250 | 880 | 650 | 75 | 800 | 35 | 15 |
| 6 | | 1250 | 880 | 650 | 75 | 800 | 35 | 15 |
| 7 | | 1250 | 880 | 650 | 75 | 800 | 35 | 15 |
| 8 | | 1250 | 880 | 650 | 75 | 800 | 35 | 15 |
| 9 | F | 1250 | 880 | 650 | 75 | 720 | 300 | 25 |
| 10 | Y | 1250 | 880 | 650 | 75 | 710 | 100 | 25 |
| 11 | A | 1250 | 880 | 650 | — | 740 | 70 | 8 |
| 12 | | 1250 | 880 | 650 | — | 780 | 70 | 15 |

| | Annealing conditions | | | Coating process | | |
|---|---|---|---|---|---|---|
| No. | Cooling stop temperature ° C. | Holding time for range from 350 to 300° C. s | Holding time for range from less than 300° C. to T1 temperature *2 s | Process temperature ° C. | Type of coating | Notes |
| 1 | 310 | 40 | 300 | 550 | GA | Example |
| 2 | 320 | 30 | 300 | 510 | GA | Example |
| 3 | 320 | 10 | 300 | 570 | GA | Example |
| 4 | 320 | 60 | 300 | 530 | GA | Comparative example |
| 5 | 320 | 40 | 200 | 460 | GI | Example |
| 6 | 320 | 40 | 500 | 470 | GI | Example |
| 7 | 320 | 40 | 800 | 450 | GI | Example |
| 8 | 320 | 40 | 0 | 25 | EG | Example |
| 9 | 260 | 20 | 400 | 25 | EG | Example |
| 10 | 260 | 10 | 200 | 25 | EG | Comparative example |
| 11 | 320 | 20 | 600 | 540 | GA | Example |
| 12 | 440 | 20 | 200 | 480 | GI | Comparative example |

*1 The average cooling rate (° C./s) is an average cooling rate over a range from the annealing temperature to 350° C.

*2 The T1 temperature (° C.) is a selectable temperature (° C.) within a temperature range of 200 to 250° C.

2. Evaluation Methods

The steel sheets (coated steel sheets) produced under different production conditions were subjected to a microstructure analysis, by which the fractions of the constituents were investigated, and to a tensile test, by which mechanical properties such as a tensile strength were evaluated. The investigation of the fractions of the constituents and the evaluations were performed in manners similar to those described in Example 1.

<Coating Adhesion>

The appearance of the coated steel sheets was visually examined; steel sheets free of bare spot defects were assigned a symbol "○", steel sheets that exhibited a bare spot defect were assigned a symbol "×", and steel sheets that were free of bare spot defects but had a non-uniform coating appearance or the like were assigned a symbol "Δ". Note that the "bare spot defect" refers to an uncoated, exposed region of a steel sheet on the order of approximately several micrometers to several millimeters. It was determined that the instances with the symbol "○" or "Δ" represented instances in which the coating was sufficiently adhered, and, therefore, good coating adhesion was achieved.

3. Evaluation Results

The results of the investigations and evaluations described above are shown in Table 5.

TABLE 5

| | | Microstructure | | | | |
|---|---|---|---|---|---|---|
| No. | Steel type | Ferrite area % | Martensite area % | Average grain diameter of martensite μm | Martensite having aspect ratio of 3 or less/entire martensite % | C concentration of martensite having aspect ratio of 3 or less mass % |
| 1 | A | 66 | 30 | 2.4 | 70 | 0.43 |
| 2 | | 57 | 39 | 2.3 | 75 | 0.35 |
| 3 | | 63 | 35 | 2.9 | 75 | 0.42 |
| 4 | | 63 | 29 | 3.0 | 55 | 0.56 |
| 5 | | 66 | 30 | 2.9 | 70 | 0.44 |
| 6 | | 55 | 40 | 2.5 | 70 | 0.37 |
| 7 | | 53 | 38 | 2.4 | 80 | 0.42 |
| 8 | | 53 | 45 | 2.3 | 60 | 0.51 |
| 9 | F | 88 | 12 | 1.8 | 85 | 0.88 |
| 10 | Y | 70 | 30 | 2.1 | 100 | 0.83 |
| 11 | A | 64 | 34 | 2.8 | 70 | 0.66 |
| 12 | | 57 | 41 | 2.9 | 50 | 0.49 |

| | Microstructure Remaining constituents | Mechanical properties | | | | |
|---|---|---|---|---|---|---|
| No. | *1 area % | YS MPa | TS MPa | YR | Coating adhesion | Notes |
| 1 | 4 | 376 | 638 | 0.59 | ○ | Example |
| 2 | 4 | 358 | 632 | 0.57 | Δ | Example |
| 3 | 2 | 352 | 640 | 0.55 | ○ | Example |
| 4 | 8 | 408 | 629 | 0.65 | ○ | Comparative example |
| 5 | 4 | 348 | 638 | 0.55 | ○ | Example |
| 6 | 5 | 360 | 642 | 0.56 | ○ | Example |
| 7 | 9 | 333 | 634 | 0.53 | ○ | Example |
| 8 | 2 | 387 | 640 | 0.60 | ○ | Example |
| 9 | 0 | 305 | 621 | 0.49 | Δ | Example |
| 10 | 0 | 328 | 638 | 0.51 | x | Comparative example |
| 11 | 2 | 381 | 643 | 0.59 | ○ | Example |
| 12 | 2 | 396 | 657 | 0.65 | ○ | Comparative example |

*1 The remaining constituents are one or more of retained austenite, bainite, and pearlite.

In Example 2, steel sheets having a TS of 590 MPa or greater, a YR of 0.63 or less, and good coating adhesion were rated as "pass" and are indicated as "Example" in the "Notes" column in Table 5. On the other hand, steel sheets having at least one of a TS of less than 590 MPa, a YR of greater than 0.63, and low coating adhesion were rated as "fail" and are indicated as "Comparative Example" in the "Notes" column in Table 5.

The invention claimed is:

1. A high-strength steel sheet having a chemical composition comprising, by mass %, C: 0.06% or greater and 0.120% or less;

Si: 0.3% or greater and 0.7% or less;

Mn: 1.6% or greater and 2.2% or less;

P: 0.05% or less;

S: 0.0050% or less;

Al: 0.01% or greater and 0.20% or less;

and N: 0.010% or less; and a balance being Fe and incidental impurities, wherein the steel sheet has a microstructure in which ferrite is present as a major phase, and martensite is present in an area fraction in a range of 10% or greater and less than 50% relative to an entire area of the microstructure, the martensite has an average grain diameter of 3.0 μm or less, in an entirety of the martensite, a proportion of martensite having an aspect ratio of 3 or less is 60% or greater, the martensite having an aspect ratio of 3 or less has a carbon concentration in a range of 0.30% or greater and 0.90% or less, by mass %, the high-strength steel sheet is a steel sheet with a tensile strength of 590 MPa or greater, and the high-strength steel sheet has a yield ratio of 0.63 or less, where the yield ratio is yield strength in MPa over tensile strength in MPa.

2. The high-strength steel sheet according to claim 1, wherein the chemical composition further comprises, by mass %, at least one selected from the group consisting of Cr: 0.01% or greater and 0.20% or less, Mo: 0.01% or greater and less than 0.15%, and V: 0.001% or greater and 0.05% or less.

3. The high-strength steel sheet according to claim 1, wherein the chemical composition further comprises, by mass %, at least one Group selected from the group consisting of:

Group A: at least one of Nb: 0.001% or greater and 0.02% or less, and Ti: 0.001% or greater and 0.02% or less, Group B: at least one of Cu: 0.001% or greater and 0.20% or less, and Ni: 0.001% or greater and 0.10% or less, and Group C: B: 0.0001% or greater and 0.002% or less.

4. The high-strength steel sheet according to claim 1, wherein a surface of the steel sheet has a coating layer.

5. The high-strength steel sheet according to claim 2, wherein the chemical composition further comprises, by mass %, at least one Group selected from the group consisting of:

Group A: at least one of Nb: 0.001% or greater and 0.02% or less, and Ti: 0.001% or greater and 0.02% or less, Group B: at least one of Cu: 0.001% or greater and 0.20% or less, and Ni: 0.001% or greater and 0.10% or less, and Group C: B: 0.0001% or greater and 0.002% or less.

6. The high-strength steel sheet according to claim 2, wherein a surface of the steel sheet has a coating layer.

7. The high-strength steel sheet according to claim 3, wherein a surface of the steel sheet has a coating layer.

8. The high-strength steel sheet according to claim 5, wherein a surface of the steel sheet has a coating layer.

9. A method for producing a high-strength steel sheet according to claim 1, the method comprising:

heating a steel slab having the chemical composition and subsequently subjecting the steel slab to a hot rolling step; and subjecting a hot-rolled steel sheet obtained in the hot rolling step to an annealing step in which:

the hot-rolled steel sheet is held at an annealing temperature of an $A_{C1}$ temperature or greater and an $A_{C3}$ temperature or less for 30 seconds or more, a resulting steel sheet is cooled under conditions in which an average cooling rate over a range from the annealing temperature to 350° C. is 5° C./second or greater, and a cooling stop temperature is 350° C. or less, and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200° C. to 250° C.

10. A method for producing a high-strength steel sheet according to claim 1, the method comprising:

heating a steel slab having the chemical composition and subsequently subjecting the steel slab to a hot rolling step;

thereafter subjecting a hot-rolled steel sheet obtained in the hot rolling step to a cold rolling step; and subjecting a cold-rolled steel sheet obtained in the cold rolling step to an annealing step in which:

the cold-rolled steel sheet is held at an annealing temperature of an $A_{C1}$ temperature or greater and an $A_{C3}$ temperature or less for 30 seconds or more, a resulting steel sheet is cooled under conditions in which an average cooling rate over a range from the annealing temperature to 350° C. is 5° C./second or greater, and a cooling stop temperature is 350° C. or less, and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200° C. to 250° C.

11. The method for producing a high-strength steel sheet according to claim 9, further comprising performing a coating process after the annealing step.

12. The method for producing a high-strength steel sheet according to claim 10, further comprising performing a coating process after the annealing step.

13. A method for producing a high-strength steel sheet according to claim 2, the method comprising:

heating a steel slab having the chemical composition and subsequently subjecting the steel slab to a hot rolling step; and subjecting a hot-rolled steel sheet obtained in the hot rolling step to an annealing step in which:

the hot-rolled steel sheet is held at an annealing temperature of an $A_{C1}$ temperature or greater and an $A_{C3}$ temperature or less for 30 seconds or more, a resulting steel sheet is cooled under conditions in which an average cooling rate over a range from the annealing temperature to 350° C. is 5° C./second or greater, and a cooling stop temperature is 350° C. or less, and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200° C. to 250° C.

14. A method for producing a high-strength steel sheet according to claim 2, the method comprising:

heating a steel slab having the chemical composition and subsequently subjecting the steel slab to a hot rolling step;

thereafter subjecting a hot-rolled steel sheet obtained in the hot rolling step to a cold rolling step; and subjecting a cold-rolled steel sheet obtained in the cold rolling step to an annealing step in which:

the cold-rolled steel sheet is held at an annealing temperature of an $A_{C1}$ temperature or greater and an $A_{C3}$ temperature or less for 30 seconds or more, a resulting steel sheet is cooled under conditions in which an average cooling rate over a range from the annealing temperature to 350° C. is 5° C./second or greater, and a cooling stop temperature is 350° C. or less, and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200° C. to 250° C.

15. The method for producing a high-strength steel sheet according to claim 13, further comprising performing a coating process after the annealing step.

16. The method for producing a high-strength steel sheet according to claim 14, further comprising performing a coating process after the annealing step.

17. A method for producing a high-strength steel sheet according to claim 3, the method comprising:

heating a steel slab having the chemical composition and subsequently subjecting the steel slab to a hot rolling step; and subjecting a hot-rolled steel sheet obtained in the hot rolling step to an annealing step in which:

the hot-rolled steel sheet is held at an annealing temperature of an $A_{C1}$ temperature or greater and an $A_{C3}$ temperature or less for 30 seconds or more, a resulting steel sheet is cooled under conditions in which an average cooling rate over a range from the annealing temperature to 350° C. is 5° C./second or greater, and a cooling stop temperature is 350° C. or less, and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200° C. to 250° C.

18. A method for producing a high-strength steel sheet according to claim 3, the method comprising:

heating a steel slab having the chemical composition and subsequently subjecting the steel slab to a hot rolling step;

thereafter subjecting a hot-rolled steel sheet obtained in the hot rolling step to a cold rolling step; and subjecting a cold-rolled steel sheet obtained in the cold rolling step to an annealing step in which:

the cold-rolled steel sheet is held at an annealing temperature of an $A_{C1}$ temperature or greater and an $A_{C3}$ temperature or less for 30 seconds or more, a resulting steel sheet is cooled under conditions in which an average cooling rate over a range from the annealing temperature to 350° C. is 5° C./second or greater, and a cooling stop temperature is 350° C. or less, and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200° C. to 250° C.

19. The method for producing a high-strength steel sheet according to claim 17, further comprising performing a coating process after the annealing step.

20. The method for producing a high-strength steel sheet according to claim 18, further comprising performing a coating process after the annealing step.

21. A method for producing a high-strength steel sheet according to claim 5, the method comprising:

heating a steel slab having the chemical composition and subsequently subjecting the steel slab to a hot rolling step; and subjecting a hot-rolled steel sheet obtained in the hot rolling step to an annealing step in which:

the hot-rolled steel sheet is held at an annealing temperature of an $A_{C1}$ temperature or greater and an $A_{C3}$ temperature or less for 30 seconds or more, a resulting steel sheet is cooled under conditions in which an average cooling rate over a range from the annealing temperature to 350° C. is 5° C./second or greater, and a cooling stop temperature is 350° C. or less, and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200° C. to 250° C.

22. A method for producing a high-strength steel sheet according to claim 5, the method comprising:

heating a steel slab having the chemical composition and subsequently subjecting the steel slab to a hot rolling step;

thereafter subjecting a hot-rolled steel sheet obtained in the hot rolling step to a cold rolling step; and subjecting a cold-rolled steel sheet obtained in the cold rolling step to an annealing step in which:

the cold-rolled steel sheet is held at an annealing temperature of an $A_{C1}$ temperature or greater and an $A_{C3}$ temperature or less for 30 seconds or more, a resulting steel sheet is cooled under conditions in which an average cooling rate over a range from the annealing temperature to 350° C. is 5° C./second or greater, and a cooling stop temperature is 350° C. or less, and subsequently, the resulting steel sheet is held under conditions in which a holding time for a temperature range from 350° C. to 300° C. is 50 seconds or less, and a holding time for a temperature range from less than 300° C. to a T1 temperature (° C.) is 1000 seconds or less, where the T1 temperature (° C.) is a selectable temperature within a temperature range of 200° C. to 250° C.

23. The method for producing a high-strength steel sheet according to claim 21, further comprising performing a coating process after the annealing step.

24. The method for producing a high-strength steel sheet according to claim 22, further comprising performing a coating process after the annealing step.

* * * * *